US009747882B1

(12) United States Patent
Micek

(10) Patent No.: US 9,747,882 B1
(45) Date of Patent: Aug. 29, 2017

(54) SWITCHED REVERSING CONFIGURATION CONTROL FOR STRING INSTRUMENTS AND BOOST CIRCUIT THEREFOR

(71) Applicant: Petr Micek, Baltimore, MD (US)

(72) Inventor: Petr Micek, Baltimore, MD (US)

( * ) Notice: Subject to any disclaimer, the term of this patent is extended or adjusted under 35 U.S.C. 154(b) by 0 days.

(21) Appl. No.: 15/487,630

(22) Filed: Apr. 14, 2017

(51) Int. Cl.
*G10H 3/18* (2006.01)

(52) U.S. Cl.
CPC ..... *G10H 3/186* (2013.01); *G10H 3/182* (2013.01)

(58) Field of Classification Search
CPC ..... G10H 3/186; G10H 3/182
USPC ..... 84/742
See application file for complete search history.

(56) References Cited

U.S. PATENT DOCUMENTS 2,897,709 A 8/1959 McCarty et al.
RE25,728 E * 2/1965 Freeman ..... G10H 3/182 84/726
3,249,677 A * 5/1966 Burns ..... G10H 3/182 84/726
3,290,424 A * 12/1966 Fender ..... G10H 3/182 84/726
3,472,943 A * 10/1969 Takeshi ..... G10H 3/182 174/113 C
3,544,696 A * 12/1970 Broussard ..... G10D 1/085 84/726
3,603,713 A * 9/1971 Nakada ..... G10H 1/06 84/697
3,663,735 A 5/1972 Evans
4,151,776 A * 5/1979 Stich ..... G10H 3/182 84/728
4,175,462 A * 11/1979 Simon ..... G10H 1/24 84/602
4,222,301 A * 9/1980 Valdez ..... G10H 3/182 84/728
4,281,573 A 8/1981 Yarema
4,405,832 A 9/1983 Sondermeyer
4,423,654 A * 1/1984 Yamagami ..... G10H 3/181 84/726
4,480,520 A 11/1984 Gold
4,532,847 A 8/1985 Youngblood
(Continued)

FOREIGN PATENT DOCUMENTS

GB 2207542 A 2/1989
GB 2235562 A 3/1991
WO 92/13337 A1 8/1992

*Primary Examiner* — David Warren
*Assistant Examiner* — Christina Schreiber
(74) *Attorney, Agent, or Firm* — Rosenberg, Klein & Lee

(57) ABSTRACT

A switched reversing configuration control for string instruments connects to a pair of pickup sensors located on an electric string instrument for selectively electrically configuring the pickup sensors between (a) the pair of pickup sensors being coupled with like polarity in one of series or parallel with respect to a pair of output terminals, or (b) effectively coupling only one of the pair of pickup sensors to the output terminals, or (c) the pair of pickup sensors being coupled with opposing polarity in one of series or parallel with respect to the output terminals. An optional reverse polarity passive boost circuit is provided for increasing the output voltage coupled to the output terminals when the pickup sensors are coupled with opposing polarity as compared to the output voltage that would otherwise be provided absent the reverse polarity passive boost circuit.

26 Claims, 16 Drawing Sheets

(56) References Cited

U.S. PATENT DOCUMENTS 4,581,974 A * 4/1986 Fender ..... G10H 3/182 84/725
4,581,975 A * 4/1986 Fender ..... G10H 3/182 84/720
4,819,537 A 4/1989 Hayes et al.
5,136,918 A * 8/1992 Riboloff ..... G10H 3/18 84/723
5,311,806 A * 5/1994 Riboloff ..... G10H 3/182 84/728
5,569,038 A 10/1996 Tubman et al.
5,761,316 A 6/1998 Pritchard
5,932,827 A * 8/1999 Osborne ..... G10H 3/18 84/726
6,034,316 A * 3/2000 Hoover ..... G10H 3/186 84/738
6,121,537 A * 9/2000 Pawar et al. ..... G10H 3/182 84/728
6,392,137 B1 * 5/2002 Isvan ..... G10H 3/182 84/726
6,998,529 B2 2/2006 Wnorowski
7,115,810 B2 * 10/2006 Ambrosino ..... G10H 1/18 84/742
7,220,912 B2 * 5/2007 Juszkiewicz ..... G10H 1/0058 84/728
7,271,332 B2 9/2007 Clark
7,304,232 B1 * 12/2007 Nicholes ..... G10H 1/46 84/741
7,601,908 B2 10/2009 Ambrosino
7,674,991 B2 3/2010 Baird et al.
7,982,123 B2 * 7/2011 Mulvany ..... G10H 3/181 84/725
8,253,007 B1 * 8/2012 Steinberger ..... G10H 1/46 338/215
8,324,495 B2 * 12/2012 Jacob ..... G10H 1/18 84/741
8,940,993 B1 * 1/2015 Micek ..... G10H 3/186 84/725
9,153,218 B1 * 10/2015 Micek ..... G10H 1/12
9,286,874 B1 * 3/2016 Micek ..... G10H 3/18
9,478,207 B1 * 10/2016 Micek ..... G10H 3/182
9,601,100 B1 * 3/2017 Dixon ..... G10H 3/181
9,646,594 B1 * 5/2017 Micek ..... G10H 3/186
2002/0073829 A1 * 6/2002 Gaglio ..... G10H 3/181 84/726
2002/0073830 A1 * 6/2002 Petherick ..... G10H 3/181 84/726
2003/0145715 A1 * 8/2003 Wnorowski ..... G10H 3/186 84/726
2004/0103776 A1 * 6/2004 Juszkiewicz ..... G10H 1/0058 84/742
2004/0159225 A1 8/2004 Barr
2005/0150364 A1 * 7/2005 Krozack ..... G10H 3/182 84/726
2006/0156912 A1 * 7/2006 Annis ..... G10H 1/08 84/742
2009/0188371 A1 * 7/2009 Chiu ..... A63F 13/02 84/314 R
2009/0308233 A1 * 12/2009 Jacob ..... G10H 1/18 84/726
2010/0282046 A1 * 11/2010 Crocker ..... G10H 1/32 84/633
2010/0307325 A1 12/2010 Appel
2011/0017048 A1 1/2011 Bos
2011/0219942 A1 9/2011 Robertson
2011/0259180 A1 * 10/2011 Gournis ..... G10H 1/348 84/746
2011/0290099 A1 * 12/2011 Franklin ..... G10H 3/182 84/733
2013/0327202 A1 * 12/2013 Mills ..... G10H 3/181 84/726
2014/0219477 A1 8/2014 Scott
2015/0024799 A1 * 1/2015 Swanson ..... H04R 1/46 455/550.1
2015/0379978 A1 * 12/2015 Jang ..... G10H 3/181 84/726

* cited by examiner

SWITCHED REVERSING CONFIGURATION CONTROL FOR STRING INSTRUMENTS AND BOOST CIRCUIT THEREFOR

BACKGROUND OF THE INVENTION

This disclosure directs itself to a reversing configuration control for electric string instruments and a boost circuit usable therewith. The reversing configuration control permits switching between various combinations of a pair of pickup sensors, either widely separated or collocated in a common enclosure, in one of series or parallel with the pickup sensors being of like polarity, a single one of the pickup sensors, and in one of series or parallel with the pickup sensors being of opposite polarity, one with respect to the other. More in particular, the disclosure is directed to a reversing configuration control for string instruments that includes a pair of pickup sensors disposed on a string instrument in which voltages are output by the sensors responsive to vibration of at least one string of the string instrument and a multipole switch providing selective operative coupling of the pair of pickup sensors in various configurations to the output terminals is provided responsive to the position of displaceable contacts of the multipole switch. Still further, the system can provide selective operative coupling of the pair of pickup sensors in combination with the pickup sensors having like polarity, selection of a single one of the pair of pickup sensors, or can provide selective operative coupling of the pair of pickup sensors in combination with one of the pickup sensors having an opposite polarity with respect to the other pickup coil. Additionally, a reverse polarity boost circuit is provided to permit selective reduction of the effect of the reversed polarity pickup sensor and thereby boost the signal level output by the novel reversing configuration control circuits disclosed herein, as well as the signal level output by prior known reversing configuration control circuits.

Electric string instruments, such as electric guitars, electric bases, electric violins, etc., use at least one pickup sensor to convert the vibration of instrument's strings into electrical impulses. The sensors may be piezoelectric devices, optical sensors, microphones or the most commonly used type of pickup sensor; that of a magnetic pickup sensors. Magnetic pickup sensors are pickup coils that use the principle of direct electromagnetic induction. The signal generated by most pickup sensors are of insufficient strength to directly drive an audio transducer, such as a loudspeaker, so they must be amplified prior to being input to the audio transducer. While many of the pickup sensors either inherently include "built-in" preamplifiers or are available with preamplifiers incorporated therein, including magnetic pickup sensors, such "active" pickup sensors still require connection to an amplifier in order to drive most audio transducers.

Because of their natural inductive qualities, all magnetic pickups tend to pick up ambient electromagnetic interference (EMI) from electrical power wiring in the vicinity, such as the wiring in a building. The EMI from a 50 or 60 Hz power system can result in a noticeable "hum" in the amplified audio by from the audio transducer, particularly with poorly shielded single-sensor pickups. Double-sensor "Humbucker" pickups were invented as a way to overcoming the problem of unwanted ambient hum sounds. Humbucker pickups have two coils that are arranged with opposite magnetic poling and corresponding oppositely wound coils to produce a differential signal with respect to signals not generated as a result of the magnetic fields of the pickup. Since ambient electromagnetic noise affects both coils equally and since they are oppositely wound, the noise signals induced in the two sensors are canceled out. The two coils of a Humbucker are often wired in series to give a fuller and stronger sound. Humbucker type pickup sensors are now also available with dual active pickups where each pickup coil is coupled to its own dedicated preamplifier.

While most single sensor pickups in multiple pickup installations are wired in parallel with each other, it is also possible to wire them in series, producing a fuller and stronger sound. The two sensors of a Humbucker type pickup can also be connected in parallel. This results in a brighter sound, but at the cost of a lower output as with a single-sensor pickup, but with the pickup's hum-cancelling properties of the Humbucker still being retained. Using a multiple pole, multiple throw switch, such as a double pole, double throw switch (DPDT) or double pole three position switch, it is known in the art to switch the sensor configuration between series and parallel, and may also provide for a "sensor cut" configuration (a single sensor output), but use of such a switch to selectively provide a reverse polarity option has not heretofore been provided in the art.

By reversing the electrical polarity of one of two pickup sensors connected in series or parallel, whether in a Humbucker pickup or a configuration of two single pickup sensors, the concept of signal cancellation can be applied to the sound signals generated from the strings of the instrument. Signals from the two sensors of the same frequency will be cancelled to some degree as a function of the phase and amplitude differences between them. As the string movement adjacent the bridge is less than adjacent the neck of the instrument, the bridge pickup will necessarily generate higher frequencies, including harmonics, than that generated by a neck pickup. To a lesser degree, the same is true for the sensors of a Humbucker pickup. The sensor of a Humbucker pickup closest to the bridge of the instrument will generate higher frequencies than the sensor which is further from the bridge. Musicians have employed this concept to change the sound of their instrument to create particular effects. The reversing of the polarity of one sensor relative to the other substantially removes the lower fundamental frequencies in the output signal from the combined pickup sensors, leaving the higher frequencies and harmonics. To that end, sensor reversing switches have been added to prior art systems. Using a passive boost circuit to reduce the amplitude of the signals from the reversed polarity sensor reduces the subtractive effect and results in a stronger sound, but still with some muting of the lower frequencies. Either of the pickup sensors in the switched reversing configuration control disclosed herein may be reversed relative to the other, although it is usually the pickup sensor closest to the bridge that is reversed relative to the other pickup sensor by conventional pickup sensor reversing circuits.

SUMMARY OF THE INVENTION

A reversing configuration control for string instruments having at least a pair of pickup sensors is provided that includes a pair of output terminals, and a respective pair of input terminals coupled to each of the pair of pickup sensors. Further, the reversing configuration control includes a multipole switch having at least two poles, at least a pair of fixed contacts for each of the poles and at least one displaceable contact for each of the poles. The displaceable contacts are mechanically coupled together for concurrent mechanical travel thereof. At least one of the poles is coupled to one of the pair of output terminals and at least one of the displaceable contacts being coupled to one of the input terminals. The multipole switch provides selective operative coupling of the pair of pickup sensors to the output terminals responsive to a position of the displaceable contacts with respect to the mechanical travel thereof. The selective operative coupling includes (a) the pair of pickup sensors being coupled with like polarity in one of series or parallel to the output terminals at a first position of the displaceable contacts, or (b) coupling only one of the pair of pickup sensors to the output terminals, or (c) the pair of pickup sensors being coupled with opposing polarity in one of series or parallel to the output terminals.

From another aspect, a reversing configuration control for string instruments is provided that includes a pair of pickup sensors, and a pair of output terminals. The reversing configuration control further includes a respective pair of input terminals coupled to each of the pair of pickup sensors. Still further, the reversing configuration control includes a multipole switch having at least two poles, at least a pair of fixed contacts for each of the poles and at least one displaceable contact for each of the poles. The displaceable contacts are mechanically coupled together for concurrent mechanical travel thereof. At least one of the poles is coupled to one of the pair of output terminals and at least one of the displaceable contacts is coupled to one of the input terminals. The multipole switch provides selective operative coupling of the pair of pickup sensors to the output terminals responsive to a position of the displaceable contacts with respect to the mechanical travel thereof. The selective operative coupling includes (a) the pair of pickup sensors being coupled with like polarity in one of series or parallel to the output terminals at a first position of the displaceable contacts, or (b) coupling only one of the pair of pickup sensors to the output terminals, or (c) the pair of pickup sensors being coupled with opposing polarity in one of series or parallel to the output terminals.

From yet a further aspect, a reverse polarity passive boost circuit is provided for increasing output signal amplitude of a string instrument having a pair of pickup sensors coupled one to the other in opposing polarity. The passive boost circuit includes an attenuation circuit coupled in one of series or parallel relationship with one of the pair of pickup sensors of the string instrument responsive to a polarity reversing control of the string instrument selecting the connection of the pair of pickup sensors coupled with opposing polarity in series or parallel to output terminals of the polarity reversing control. The attenuation circuit attenuates signals of a selected frequency band generated by the one pickup sensor coupled in series or parallel therewith and thereby increases amplitude of signals resulting from summation of signals generated respectively by the pair of pickup sensors within the selected frequency band.

DETAILED DESCRIPTION OF THE PREFERRED EMBODIMENTS

Figure 1A:
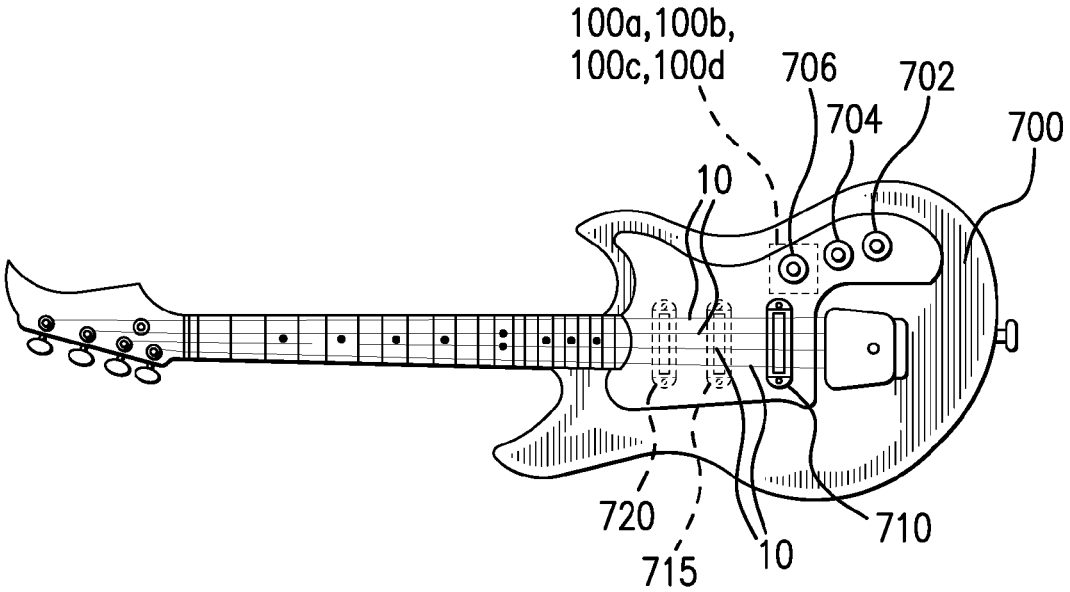
FIG. 1A is an illustration of an electric string instrument incorporating the switched reversing configuration control of the present invention and showing typical locations of pickup transducers for sensing string vibrations.

Referring to FIGS. 1A-5C, there is shown switched reversing configuration control 100*a*, 100*b*, 100*c*, 100*d* for use with an electric string instrument. Switched reversing configuration control 100*a*, 100*b*, 100*c*, 100*d* provides selective variation the electrical configuration of a pair of pickup sensors 150 and 160 between being connected with their polarity being in common in one of series or parallel, effectively providing the output of a single one of the pickup sensors, and being connected with the polarity of one pickup sensor having an opposite polarity respect to the other while being in one of series or parallel.

As used herein the terms "like polarity," "common polarity," "polarity in common," "same polarity" and the like all refer to the pickup sensor property known as phase, where the two pickup sensor outputs are in-phase (have the same phase). The phase property of a pickup sensor is a designation of the direction that current flows through that sensor and usually indicated by a plus (+) symbol representing outgoing current (positive terminal), and a minus (−) symbol representing incoming current (negative terminal). With the signals output by the two pickup sensor being in-phase, the signal currents or voltages are additive, as a function of whether they are connected in parallel or series. The terms "opposite polarity", "opposing polarity", "reverse polarity" and the like refer to the two pickup sensor outputs being out of phase (having an opposite phase), i.e. having current flows that are 180 degrees out of phase with each other. When the signals output by the two pickup sensors are out of phase, the signal currents or voltages are subtractive, as a function of whether they are connected in parallel or series.

When pickup sensors of like or common polarity are coupled in series, the plus designated terminal (outgoing current) of one pickup sensor is connected to the minus designated terminal (incoming current) of the other pickup coil. In the case where pickup sensors of opposite polarity are coupled in series, the plus designated terminal of one pickup sensor is connected to the plus designated terminal of the other pickup coil, or the minus designated terminal of one pickup sensor is connected to the minus designated terminal of the other pickup coil. When pickup sensors of like or common polarity are coupled in parallel, the plus designated terminals of the two pickup sensors are connected together and the minus designated terminals of the two pickup sensors are also connected together. Whereas, when pickup sensors of opposite polarity are coupled in parallel, the plus designated terminal of a first of the pickup sensors is connected to the minus designated terminals of the second pickup sensor and the plus designated terminal of that second pickup sensor is connected to the minus designated terminal of the first pickup sensor.

In the series mode, with pickup sensors of like polarity, the output will be strong with a smooth attack and a deep tone, in the single sensor mode the output will be classic single tone, and in the parallel mode, with pickup sensors of like polarity, the sound will be very clean and sparkly. When one of the pickup sensors is connected with a reverse polarity relative to the other pickup coil, the series and parallel effects are modified by the cancellation of the lower fundamental frequencies of the sound signals and often used in performances of both rock and country music.

As is known in the art, one or more pickup devices are positioned in correspondence with the strings of the instrument so that they are able to produce an electrical signal in response to vibration of at least one of the multiple strings of the instrument. A Humbucker type pickup device is a magnetic pickup device that is commonly used with electric string instruments because they provide for cancellation of electromagnetic interference (EMI), such as the 50 or 60 Hz "hum" that is induced from nearby electrical power wiring. As shown in FIG. 1B, the Humbucker type pickup device 710 has two pickup sensors 150 and 160 in the form of coils that are installed in a single enclosure. The two coils are poled (magnetic field direction) and phased (electrical polarity) to provide cancellation of common mode noise signals.

Figure 1B:
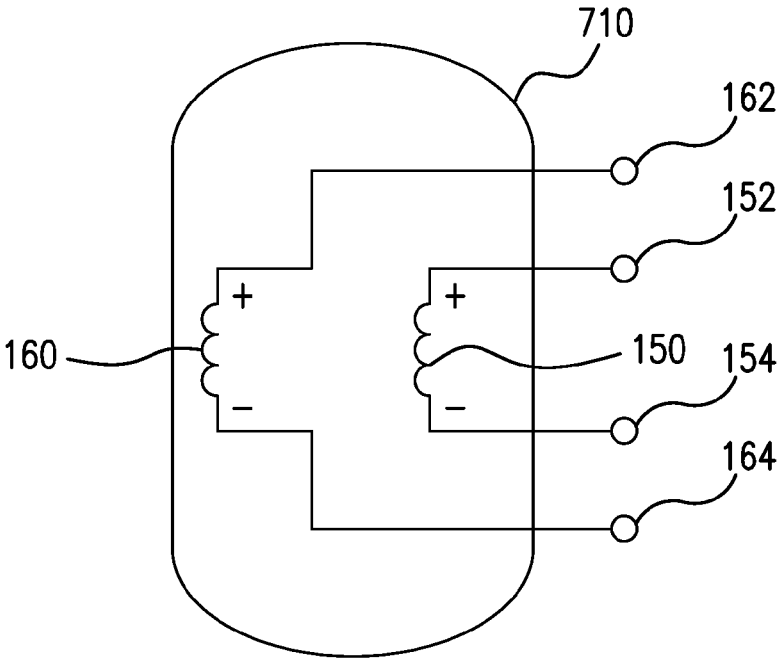
FIG. 1B is a schematic illustration of a Humbucker type pickup sensor for string instruments useable in the present invention.

Shown in FIG. 1A, is an exemplary electric string musical instrument 700 in the form of a guitar that incorporates switched reversing configuration control 100*a*, 100*b*, 100*c*, 100*d*. As is typical of such musical instruments, guitar 700 includes a plurality of strings 10, the vibrations of which are sensed by at least the pickup device, hereinafter referred to simply as a "pickup." Guitar 700, therefore, includes at least one pickup 710, which may be a Humbucker type pickup. Using the switched reversing configuration control 100*a*, 100*b*, 100*c*, 100*d*, the two pickup sensor coils 150 and 160 of a Humbucker type pickup 710, the pickup sensor coils 150 and 160 can be selectively connected in different configurations. Although only a single pickup sensor is necessary for the guitar to function as a musical instrument, a broad range and variation of sounds can be generated using multiple pickup sensors located in spaced relationship, one with respect to the other. The pickup 710 is located on the guitar 700 in proximity to the bridge of the instrument. As an alternative to a Humbucker type pickup, the pickup 710 may house a single pickup sensor with another single sensor pickup 715 or 720 being located on the guitar 700 for connection to the switched reversing configuration control 100*a*, 100*b*, 100*c* or 100*d*. In this alternative arrangement, the pickup 710 will include the pickup sensor 160 and the other pickup 715 or 720 will include the pickup sensor 150. The bridge being an anchor point for the strings, limits the displacement of the strings adjacent thereto. As a result, higher frequency components of the sound are transduced by the pickup 710. The optional pickup 720, on the other hand, is located in proximity to the neck of the guitar 700. Since the neck region is a relatively substantial distance from the anchor points of the strings, the strings are able to vibrate with greater amplitude (move a greater distance) and thereby produce lower frequency components of the sound. The optional pickup 715 is located between the neck and bridge, where the strings have greater movement compared to the bridge, but less movement than the region adjacent the neck and therefore produce frequency components intermediate to those sensed at the bridge and neck pickup locations.

Thus, switched reversing configuration control 100*a*, 100*b*, 100*c* or 100*d* can be connected to the single sensor pickups 710 and 715 or 710 and 720, as examples. Although switched reversing configuration control 100*a*, 100*b*, 100*c* or 100*d* may be utilized to configure the pickups 715 and 720, rather than a combination using pickup sensor 710, and in fact pickups at any two pickup locations, it is believed that a combination that includes a sensor adjacent to the bridge provides a better sounding combination for use in reverse polarity sensor configurations, where common frequency components generated by the sensors are cancelled or attenuated to some degree, as a function of their phase and amplitude differences.

FIG. 1B schematically illustrates the arrangement of a Humbucker type pickup 710 which may be used in place of the exemplary combinations of separate single sensor pickups 710 and 720 or 710 and 715 of the guitar 700. The Humbucker type pickup 710 includes a pair of pickup sensor 160 and 150 in the form of coils (magnetic sensors). Sensor 160 has a pair of terminals 162 and 164 connected to opposing ends thereof. Similarly, sensor 150, has a pair of terminals 152 and 154 connected to its opposing ends. As is known in the art, Humbucker sensor coils are arranged to be of opposite magnetic and electric polarity so as to produce a differential signal. Since ambient electromagnetic noise affects both sensors equally and since the sensors are wound oppositely, the noise signals induced in the two sensors cancel each other out. The two sensors of a Humbucker are often wired in series to give a fuller and stronger sound. The two sensors of a Humbucker type pickup can also be connected in parallel, which results in a brighter sound, albeit with a weaker output, but with the pickup's hum-cancelling properties still being retained. Obviously, when the output of the pickup is selected by the switched reversing configuration control 100*a*, 100*b*, 100*c* or 100*d* to be from only a single one of the two sensors, there will be no hum cancellation but, also there will be no ambient electromagnetic noise filtering effect, as occurs when the two sensors are connected in series or parallel. No hum-cancelling effect results then the electrical polarity of one sensor is reversed either, but the cancellation effect of the fundamental frequencies of the string vibrations is a much greater and desirable effect that is achieved by this configuration.

As a result of these differences in the sound effects generated by the different connection schemes of the two sensors of the Humbucker type pickup 710 or in the alternative where multiple single sensor pickups are utilized, different connection schemes of the sensors of pickups 710 and 720 or 710 and 715, the musician playing guitar 700 will use switched reversing configuration control 100*a*, 100*b*, 100*c* or 100*d* to select or configure the signals output from the sensors of the pickups.

Figure 1C:
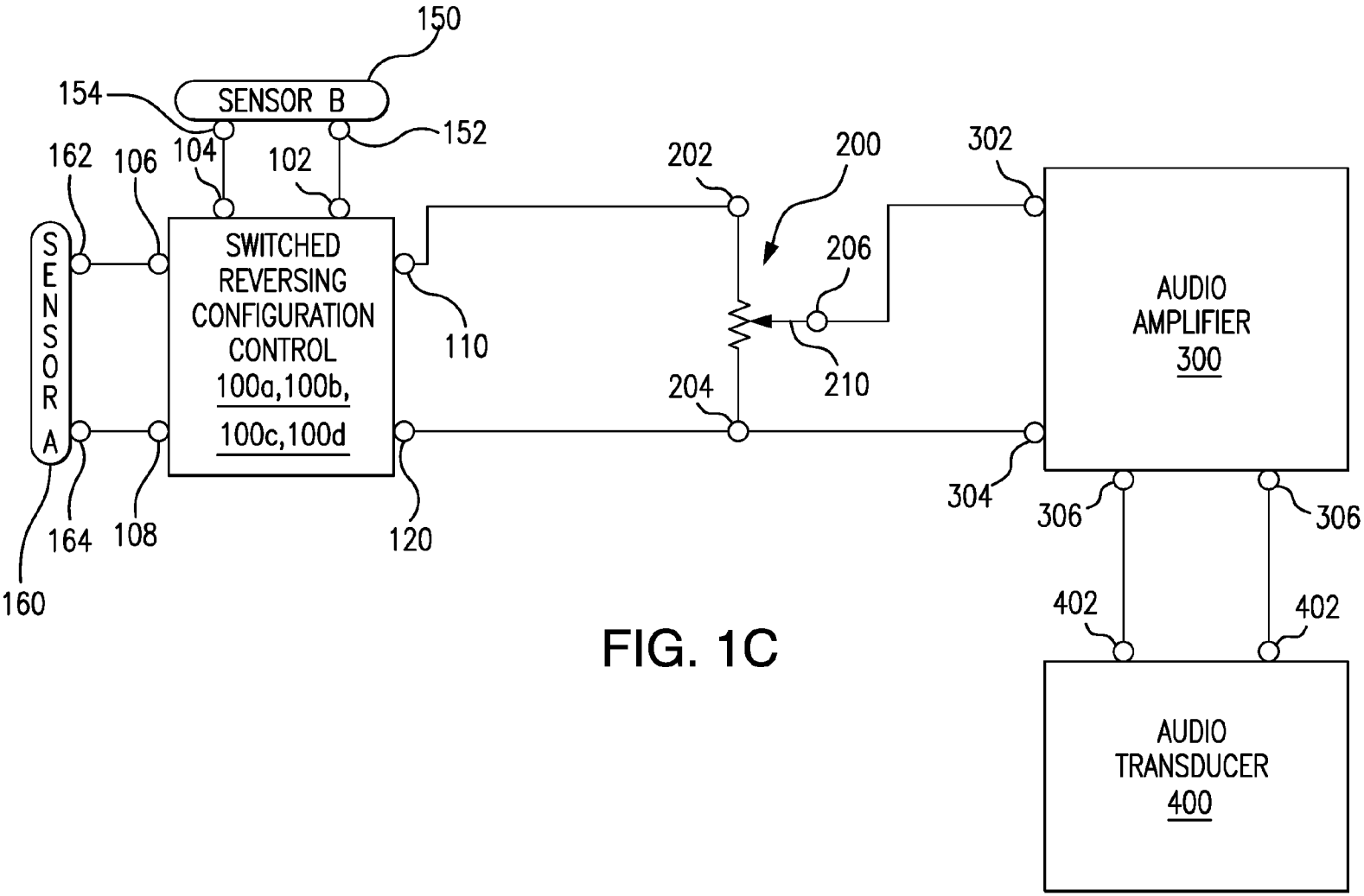
FIG. 1C is a block diagram illustrating the basic audio system for an electric string instrument incorporating the switched reversing configuration control of the present invention.

Referring additionally to FIG. 1C, guitar 700 is provided with rotatable control knobs 702, 704 and 706. Control knob 702 is connected to a tone control (not shown in the figures), allowing the musician to vary the sounds from the guitar 700 by changing the filtering applied to the electrical signals before they are coupled to the amplifier 300. Control knob 704 is connected to the shaft of the volume control potentiometer 200, allowing the musician to vary the volume while playing the instrument. Control knob 706 is connected to a multiple pole switch of the switched reversing configuration control 100*a*, 100*b*, 100*c* or 100*d*, having at least three positions and two poles, to provide selection and/or configuration changing of the pickup sensors 150 and 160. Alternately, the control knob 706 may be replaced by a pivotable switch actuator of a multipole toggle type switch or a displaceable actuator of a multiple pole slide type switch. It should be understood that where multiple Humbucker type pickups are utilized on a string instrument a separate switched reversing configuration control 100*a*, 100*b*, 100*c* or 100*d* can be connected to the sensors of each respective Humbucker type pickup.

Turning now specifically to FIG. 1C, there is shown a block diagram of the basic audio system for an electric string instrument that incorporates the novel switched reversing configuration control 100*a*, 100*b*, 100*c* or 100*d* disclosed herein. The pickup sensors 160 (sensor A) and 150 (sensor B) generate voltage signals responsive to the vibrational movement of the strings of a stringed instrument, such as guitars, violins, cellos, harps, banjos, mandolins, bases, etc. and the switched reversing configuration control 100*a*, 100*b*, 100*c* or 100*d* configures how the generated voltages are combined or selects the output of sensor A 160 alone.

The sensors 150 and 160 may be piezoelectric devices, optical sensors, microphones or the most commonly used type of pickup sensor; that of a magnetic pickup sensors (pickup coils). A piezoelectric pickup would be attached to the string retainer point on the bridge, as opposed to being adjacent to it. Piezoelectric, optical and microphone pickups include a preamplifier and thus, considered to be active type sensors. Magnetic sensors can be active sensors as well, wherein the signals supplied to the respective terminals 152 and 154, 162 and 164 of sensors 150, 160 are provided via a corresponding preamplifier connected to the sensing coil and incorporated in the pickup housing. Sensor A 160 has a pair of output terminals 162 and 164 that are respectively connected to input terminals 106 and 108 of switched reversing configuration control 100*a*, 100*b*, 100*c*, 100*d*, and sensor B 150 has a pair of output terminals 152 and 154 that are respectively connected to input terminals 102 and 104 of switched reversing configuration control 100*a*, 100*b*, 100*c*, 100*d*.

The generated signals, as configured or selected are output to terminals 110 and 120, which are respectively connected to terminals 202 and 204 of volume control 200. Volume control 200 is a potentiometer that functions as a voltage divider with its displaceable contact connected to an output terminal 206. The signal level at output terminal 206 relative to terminal 204 will be in relation to the resistance between those terminals with respect to the total resistance between terminals 202 and 204. The output of volume control 200 provided from terminals 206 and 204 are respectively coupled to terminals 302 and 304 of an audio amplifier 300. Although not illustrated in FIG. 1C, it is common to add various additional tone controls between the output of volume control 200 and the input of audio amplifier 300, in the form of resistance-capacitance (RC) filters where the resistance element is a potentiometer.

The output signal level of Humbucker type pickups may be on the order of 100-500 mV, which can then be reduced by adjustment of volume control 200. Audio amplifier 300 increases the signal level, voltage and current, sufficiently to drive an audio transducer 400, such as headphones or one or more speakers. The output terminals 306 of audio amplifier 300 are connected to the input terminals 402 of audio transducer 400. Although, audio amplifier 300 is shown with a single pair of output terminals, it should be understood that multiple separate outputs may be provided to simultaneously drive a plurality of audio transducers 400.

Figure 2A:
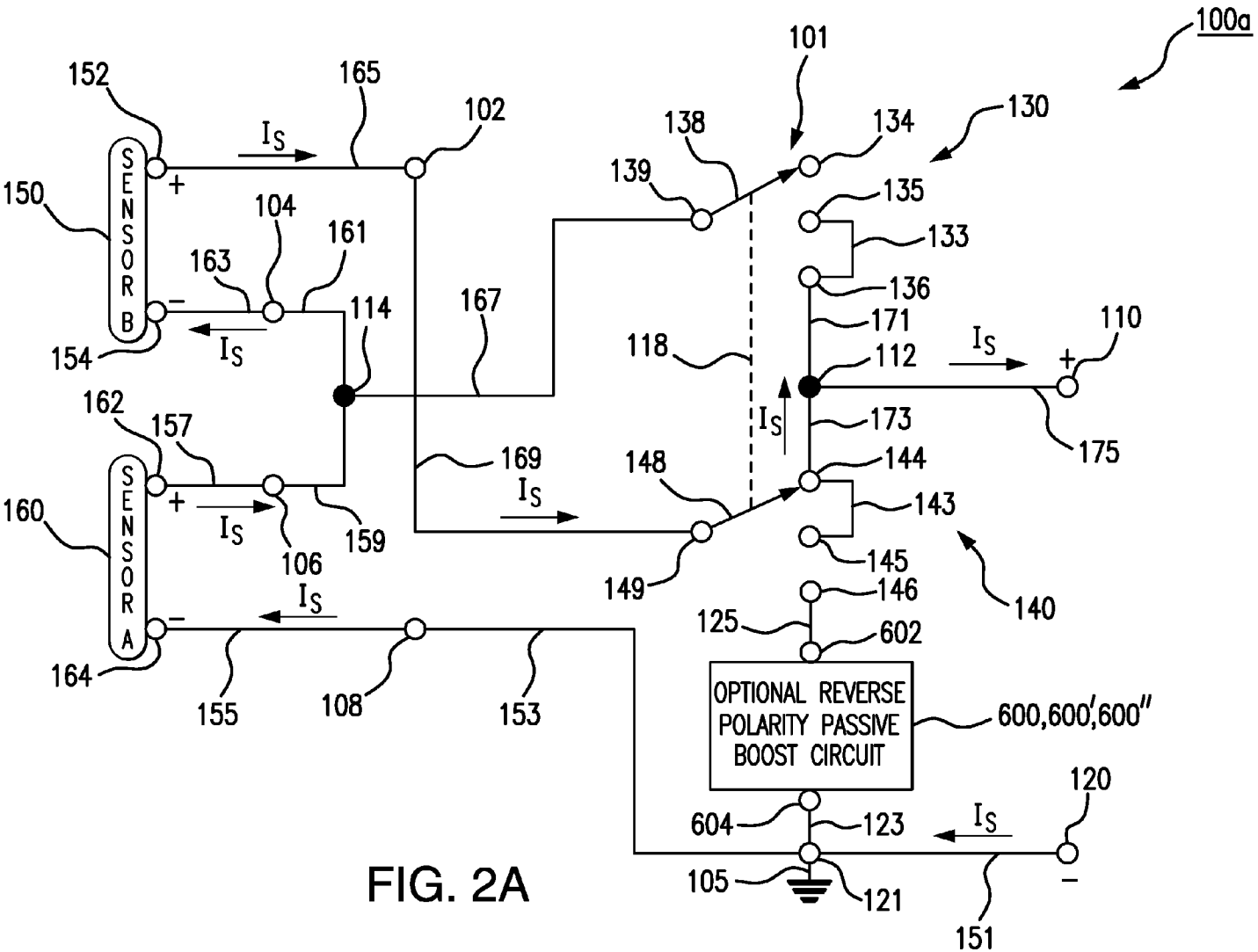
FIG. 2A is a schematic electrical diagram of the switched reversing configuration control of the present invention adjusted for a series configuration of pickups of common polarity.
Figure 2B:
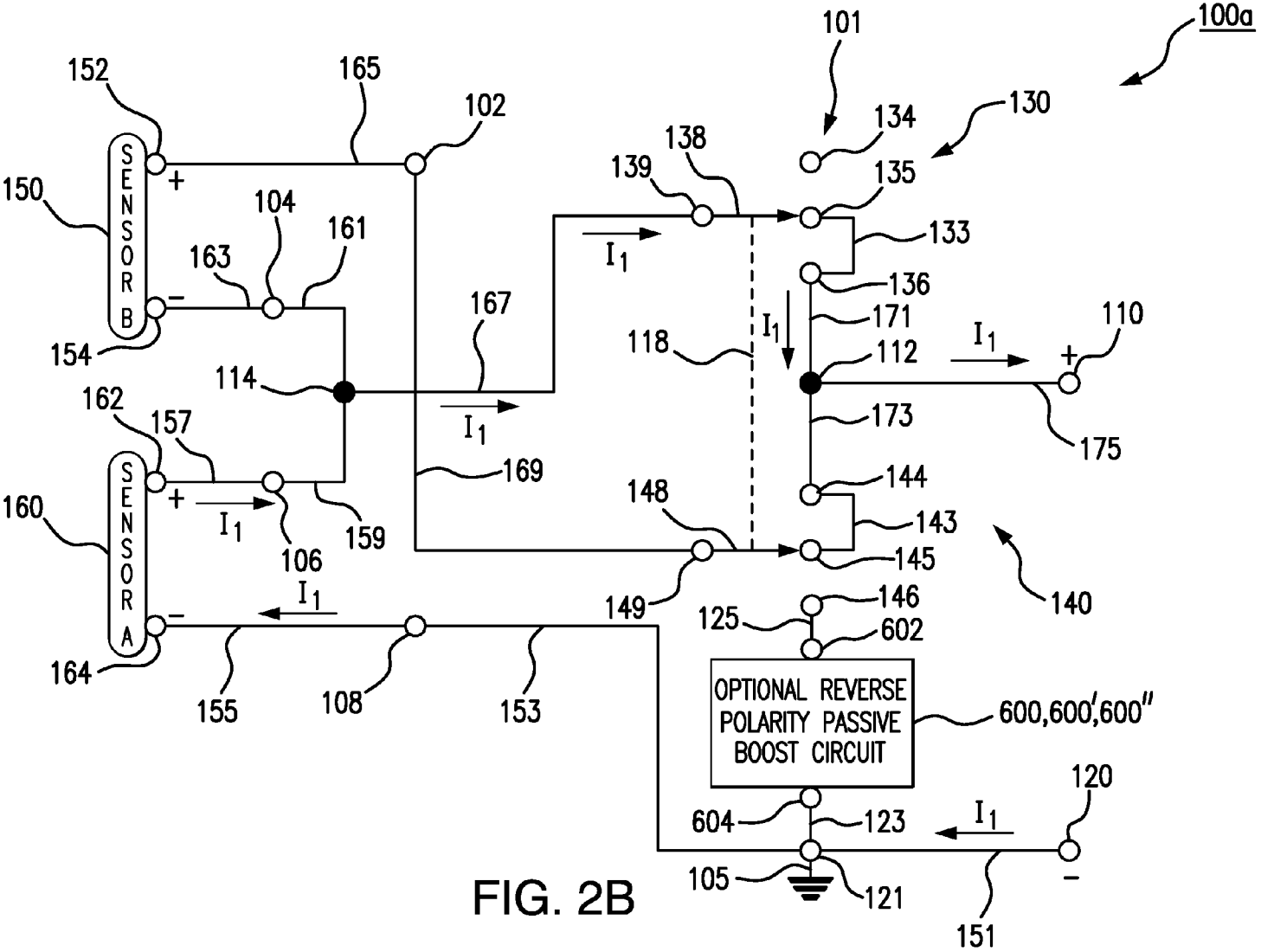
FIG. 2B is a schematic electrical diagram of the switched reversing configuration control adjusted for a single sensor configuration.
Figure 2C:
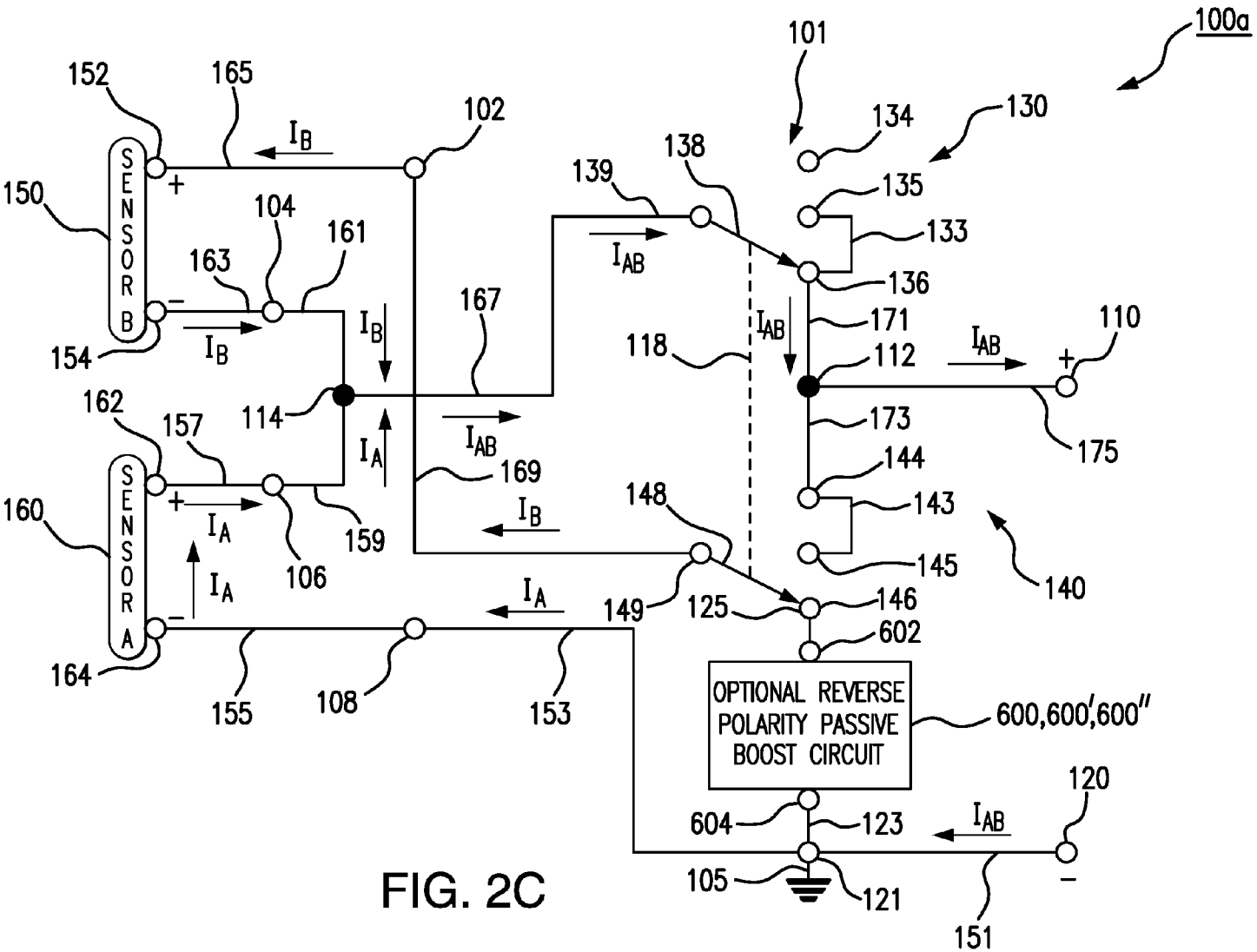
FIG. 2C is a schematic electrical diagram of the switched reversing configuration control adjusted for a parallel configuration of pickups of opposite polarity.

Switched reversing configuration control 100*a*, 100*b*, 100*c* or 100*d*, as shown in FIGS. 2A, 2B, 2C, 3A, 3B, 3C, 4A, 4B, 4C, 5A, 5B and 5C utilize a multipole switch 101 having at least the two switch poles 130 and 140. As is typical of multipole switches, the displaceable contacts 138 and 148 of poles 130 and 140 are mechanically coupled together, as represented by the coupling line 118, and may be rotary or linear movement type switching device. In FIGS. 2A, 2B and 2C, there are shown schematic diagrams of switched reversing configuration control 100*a* at different respective settings (switch positions) to demonstrate the changes in pickup sensor configuration that are obtained therewith. Switched reversing configuration control 100*a* includes multipole switch 101 having at least a pair of switch poles 130 and 140 that provide the mechanism for changing the configuration of the pair of pickup sensors 150 and 160 between being coupled in series with like polarities (in phase) at one position of the displaceable contacts 138 and 148 of the corresponding poles 130 and 140 and being coupled in parallel with opposing polarities (out of phase) at another position of the displaceable contacts 138 and 148. At yet another position of the displaceable contacts 138 and 148, the output of a single pickup sensor 160 is coupled to the output terminals 110 and 120. Switch pole 130 has a jumper lead 133 interconnecting the switch terminals 135 and 136. Similarly, switch pole 140 has a jumper lead 143 interconnecting the switch terminals 145 and 144. Although a particular sequence of pickup sensor configuration/selection is illustrated, i.e. the intermediate position being the selection of a single sensor, the association of a particular position with a particular configuration/selection is alterable by corresponding changing the connection to the switch poles to achieve the desired switching sequence.

Pickup sensors 150 and 160 may be two separately mounted individual sensors located on the instrument, each in proximity to the strings 10 at different locations along their extent. Single sensor pickups having the designation SSL-1 and SSL-5 available from the Seymour Duncan Company of Goleta, Calif. have been successfully used with switched reversing configuration control 100*a*, 100*b*, 100*c*, 100*d*. As previously discussed, a Humbucker pickup with two collocated sensors provided in a single package is also usable with switched reversing configuration control 100*a*, 100*b*, 100*c*, 100*d*. In one working embodiment, pickup sensors 150 and 160 were implemented with a humbucking series EMG-HZ type pickup available from EMG, Inc. of Santa Rosa, Calif. Both types of pickup sensor, single pickup sensor type and Humbucker type, are well known and widely available.

The following connections apply to each of FIGS. 2A, 2B, and 2C of switched reversing configuration control 100*a*, and 3A, 3B and 3C of switched reversing configuration control 100*b*. Output terminal 120 is connected by conductor 151 to terminal 121 that in turn is connected to a ground reference 105. All of the conductors of switched reversing configuration control 100*a*, 100*b*, 100*c*, 100*d* may formed by conductive wires, conductive tracks on a printed circuit board, or a combination thereof. Terminal 121 is further connected to input terminal 108 by conductor 153 and input terminal 108 is connected by conductor 155 to negative output terminal 164 of pickup sensor A 160. The opposing positive output terminal 162 of pickup sensor 160 is coupled to input terminal 106 by conductor 157. Input terminal 106 is connected to a node 114 by conductor 159, as is the input terminal 104 via the corresponding conductor 161. Node 114 is connected to the displaceable contact terminal 139 of switch pole 130 by the conductor 167.

Input terminal 104 is connected to the negative output terminal 154 of pickup sensor B 150 by the conductor 163 and the opposing positive output terminal 152 of pickup sensor 150 is coupled to input terminal 102 by conductor 165. Input terminal 102 is connected to the displaceable contact terminal 149 of switch pole 140 by the conductor 169. The terminal 134 of switch pole 130 is open circuited (unconnected) and the opposing terminal 136 is connected to the intermediate terminal 135 by the conductor (jumper) 133 and to the node 112 by the conductor 171. Similarly, the terminal 144 of potentiometer 140 is connected to the node 112 by the conductor 173 and node 112 is in turn coupled to output terminal 110 by the conductor 175.

As will be discussed in following paragraphs, the switched reversing configuration controls 100*a* and 100*b* may optionally include a reverse polarity passive boost circuit 600, 600', 600" coupled between the terminals 121 and 146 via the conductor 125 coupling the terminal 146 to the terminal 602 and the conductor 123 coupling the terminals 121 and 604 together. When the reverse polarity passive boost circuit 600, 600', 600" is not incorporated in the switched reversing configuration controls 100*a*, 100*b*, a "jumper" defined by a conductor 601 connected between the terminals 602 and 604 (shown in FIG. 6A) is substituted to provide electrical coupling between the terminals 121 and 146.

Reference numerals presented in FIGS. 2A, 2B and 2C that are in common with those in FIG. 1 represent the same elements. The functioning of switched reversing configuration control 100*a* will now be described, beginning with the displaceable contacts 138, 148 being at a first end of their respective mechanical travel, as shown in FIG. 2A. At the first end of mechanical travel, the displaceable contact 138 is connected to the open circuit terminal 134, and the displaceable contact 148 is connected to switch terminal 144 and thereby electrically connected to output terminal 110 through conductors 173 and 175 via the intervening node 112. While it is the pickup sensors 150 and 160 that generate the current that flows to and from output terminals 110 and 120 responsive to vibrational movement of the strings 10 of the instrument 700 incorporating switched reversing configuration control 100*a*, for simplicity we will start by following a current $I_S$ flowing into the negative output terminal 120. The current $I_S$ flows to input terminal 108 and on to pickup sensor 160 negative output terminal 164 through the conductors 151, 153 and 155 and intervening terminals 121 and 108.

From terminal 164, the current $I_S$ flows from the negative terminal 164 of pickup sensor 160, through the pickup sensor 160 to the positive output terminal 162 thereof and through the conductor 157 to input terminal 106. The current Is flows from input terminal 106 to the terminal 104 via the conductor 159, the node 114 and the conductor 161. The node 114 is connected to the displaceable contact terminal 139 of switch pole 130, which is connected to the open circuit terminal 134. Therefore, no current flows through the path from node 114 to terminal 139. The current $I_S$ flows through the pickup sensor 150 to the positive output terminal 152 and through conductor 165 to input terminal 102. From input terminal 102, the current Is flows through the conductor 169 to the displaceable contact terminal 149 of switch pole 140 and through the displaceable contact 148 to terminal 144. From terminal 144 of switch pole 140, the current $I_S$ flows to output terminal 110 through conductor 173, node 112 and conductor 175, thereby completing the current path through switched reversing configuration control 100*a*. Clearly, as the same current, $I_S$, flows through both pickup sensors 160 and 150, with the positive terminal of sensor 160 connected to the negative terminal of sensor 150, the pickup sensors are coupled in series with like polarity. For series coupled pickup sensors, the voltages generated in the sensors is additive. For magnetic type pickups, the series connected pickup sensors provide a higher impedance to higher frequency audio signals being transduced and thereby provide a filtering effect. Hence, the series connection of magnetic type pickup sensors is said to provide a fuller and stronger sound. The series connection of other types of pickup sensors also provides a stronger sound, as the output signals therefrom are additive, but do not provide the filtering effect.

As shown in FIG. 2B, the multipole switch 101 is set with the displaceable contacts 138 and 148 of respective poles 130 and 140 positioned at the intermediate position of their mechanical travel to contact corresponding terminals 135, 145. As previously discussed, the switch terminal 135 is electrically connected to the switch terminal 136 by the conductor 133 connected therebetween. Likewise, the conductor 143 electrically connects the switch terminal 145 to the switch terminal 144.

A current $I_1$ flows into the negative output terminal 120 to input terminal 108 and negative output terminal 164 of the pickup sensor 160 through the conductors 151, 153 and 155 and intervening terminals 121 and 108. Node 121, aside from being connected to the ground reference 105, is connected to terminal 604 via the interconnecting conductor 123, and terminal 604 is connected to the switch terminal 146, either through the conductor 601 (FIG. 6A), terminal 602 and conductor 125 or through the optional reverse polarity passive boost circuit 600, 600', 600", terminal 602 and conductor 125. However, as the displaceable contact 148 is connected to the intermediate terminal 145, terminal 146 is an open circuit and therefore no current flows through the aforesaid path between terminals 121 and 146.

From terminal 164, the current $I_1$ flows through the pickup sensor 160 to the positive output terminal 162 thereof and through the conductor 157 to input terminal 106. The current $I_1$ flows from input terminal 106 to node 114 to the displaceable contact terminal 139 of switch pole 130, via conductors 159 and 167, and through the jumper conductor 133 to the switch terminal 136. From terminal 136, the current $I_1$ flows to output terminal 110 through conductor 171, node 112 and conductor 175. You will note that the negative terminal 154 of pickup sensor 150 is likewise coupled to node 112 through switch pole 130 by virtue of terminal 154 being connected to node 114 via conductor 163, input terminal 104 and conductor 161. The opposing positive terminal 152 of pickup sensor 150 is also connected to the node 112 by conductor 165, input terminal 102, conductor 169, and the switch pole 140, via displaceable contact terminal 149, displaceable contact 148, terminal 145, the jumper conductor 143, terminal 144 and conductor 173. Since both the positive and negative output terminals of pickup sensor 150 are coupled to node 112, the output of pickup sensor 150 is shunted (short circuited) from the output terminals 110 and 120 and does not contribute to the output signal of switched reversing configuration control 100*a*. Therefore, at the intermediate position of the of the travel of multipole switch 101, only the output signals from the pickup sensor 160 are coupled to terminals 110 and 120, to provide the conventional single sensor full frequency spectrum sound.

Turning now to FIG. 2C, the switch poles 130, 140 are set with the displaceable contacts 138, 148 positioned at the opposing second end of their respective mechanical travel compared with that of FIG. 2A. Starting again at negative output terminal 120, the current $I_{AB}$ flows to terminal 121 where it divides into a current $I_A$ flowing to input terminal 108 via conductor 153 and a current $I_B$ flowing to terminal 146 of switch pole 140 through conductor 123, to terminal 604. Terminal 604 is connected to the switch terminal 146, either through the conductor 601 (FIG. 6A), terminal 602 and conductor 125 or through the optional reverse polarity passive boost circuit 600, 600', 600", terminal 602 and conductor 125.

From input terminal 108, the current $I_A$ flows through the pickup sensor 160 via conductor 155 and negative pickup sensor terminal 164 to the input terminal 106 by way of positive pickup sensor terminal 162 and conductor 157. The current $I_B$ flows from terminal 146 through displaceable switch contact 148 and terminal 149, to then flow to the positive pickup sensor terminal 152 through conductor 169, input terminal 102 and conductor 165. From there, the current $I_B$ flows through the pickup sensor 150 to the negative pickup sensor terminal 154 and therefrom to input terminal 104 through conductor 163. The current $I_A$ flows from input terminal 106 to the node 114 through conductor 159 to be combined with the current $I_B$ flowing from input terminal 104 through conductor 161 to node 114 to form the current $I_{AB}$.

The combined current $I_{AB}$ flows from node 114 to switch terminal 136 of switch pole 130 via conductor 167, terminal 139 and displaceable contact 138. From terminal 136, the current $I_{AB}$ flows to output terminal 110 through the conductor 171, node 112 and conductor 175. No current flows from node 112 through the switch pole 140, as terminals 144 and 145 are open circuited. Hence, the switch setting in this example provides two parallel branches with a respective one of the two pickup sensors being in each branch. However, it can be seen that the negative terminal of pickup sensor 150 and the positive terminal of the pickup sensor 160 are coupled in common to the positive output terminal 110 and the negative terminal of the pickup sensor 160 and the positive terminal of pickup sensor 150 are coupled in common to the negative output terminal 120. Thus, the polarity of one pickup sensor with respect to the other is reversed, which results in subtraction of signals generated by the two sensors as a function of their respective amplitudes and phase differences, producing a difference signal at the output terminals 110, 120 of switched reversing configuration control 100*a*. Accordingly, signals of equal amplitude and of like frequency and phase will be cancelled out. As the distance between the two pickup sensors on the instrument will determine the phase difference in the signals generated by the two pickup sensors and range of signal frequencies generated will be determined by their locations on the instrument, greater cancellation of signals will be obtained when using two sensors of a Humbucker type pickup than when using a single bridge pickup sensor and a single neck pickup coil, as an example.

The polarity of either of pickup sensors 150 or 160 can be reversed in their connection to switched reversing configuration control 100*a*. Thus, the positive terminal 152 of pickup sensor 150 can be connected to input terminal 104 and the negative terminal 154 thereof correspondingly connected to input terminal 102. Alternately, the positive terminal 162 of pickup sensor 160 can be connected to input terminal 108 and the negative terminal 164 thereof correspondingly connected to input terminal 106. With this alternative connection scheme for one of the pickup sensors, switched reversing configuration control 100*a* provides the pickup sensors 150 and 160 in a series configuration with opposing polarity at the first end of the mechanical travel of displaceable contacts 138, 148; only the pickup sensor 160 output at the intermediate position of the mechanical travel of displaceable contacts 138, 148; and provides the pickup sensors 150 and 160 in a parallel configuration with like polarity at the second end of the mechanical travel of displaceable contacts 138, 148.

Figure 6A:
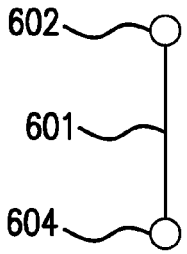
FIG. 6A is a schematic electrical diagram of the alternate circuit connections in FIGS. 4A, 4B and 4C when the optional reverse polarity passive boost circuit is omitted.

As previously discussed, where the optional reverse polarity passive boost circuit 600, 600', 600" is not employed with switched reversing configuration control 100*a*, 100*b* or 100*d*, a jumper conductor 601 is connected between the terminal 602 and 604, as shown in FIG. 6A. Switched reversing configuration control 100*a*, 100*b* or 100*d* connects the two pickup sensors 150 and 160 with the polarity of one pickup sensor reversed with respect to the polarity of the other, in a parallel configuration. The parallel configuration has the characteristic of a lower output voltage compared to that of the series configuration, even when the polarity of the pickup sensors is not reversed. Thus, with the signals of the two pickup sensors 150 and 160 being combined in a subtractive manner in the reverse polarity configuration, the output voltage of parallel connected pickup sensors is further reduced for a significant portion of their output frequency bandwidth. Adding the reverse polarity passive boost circuit 600, 600', 600" to switched reversing configuration control 100*a*, 100*b* or 100*d* functions by reducing the subtractive effect of the reversed pickup sensor for some or all of the signal frequencies being transduced to thereby increase the output voltage for the combined pickup sensors.

Figure 3A:
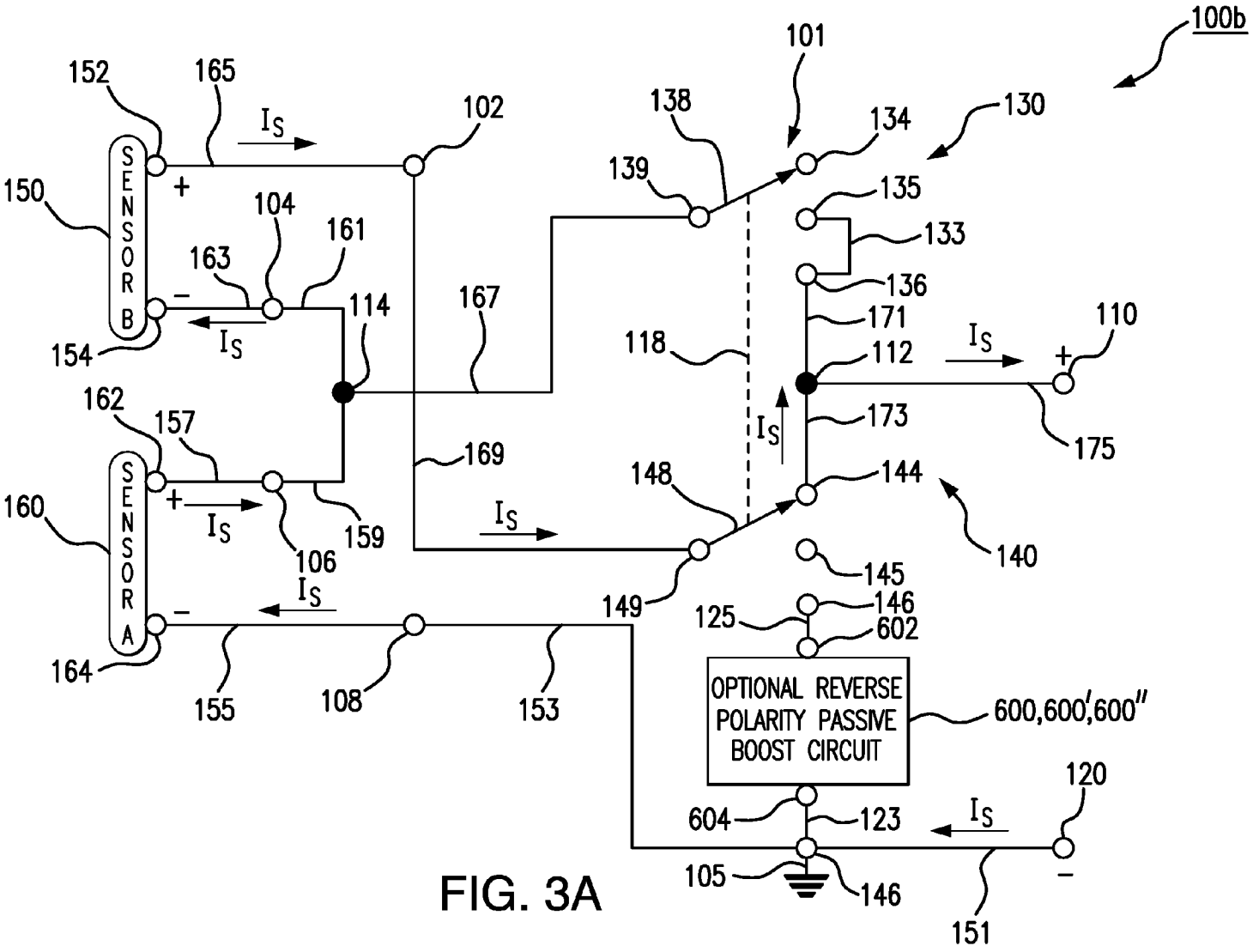
FIG. 3A is a schematic electrical diagram of the switched reversing configuration control of the present invention with an alternate switch arrangement adjusted for a series configuration of pickups of common polarity.
Figure 3B:
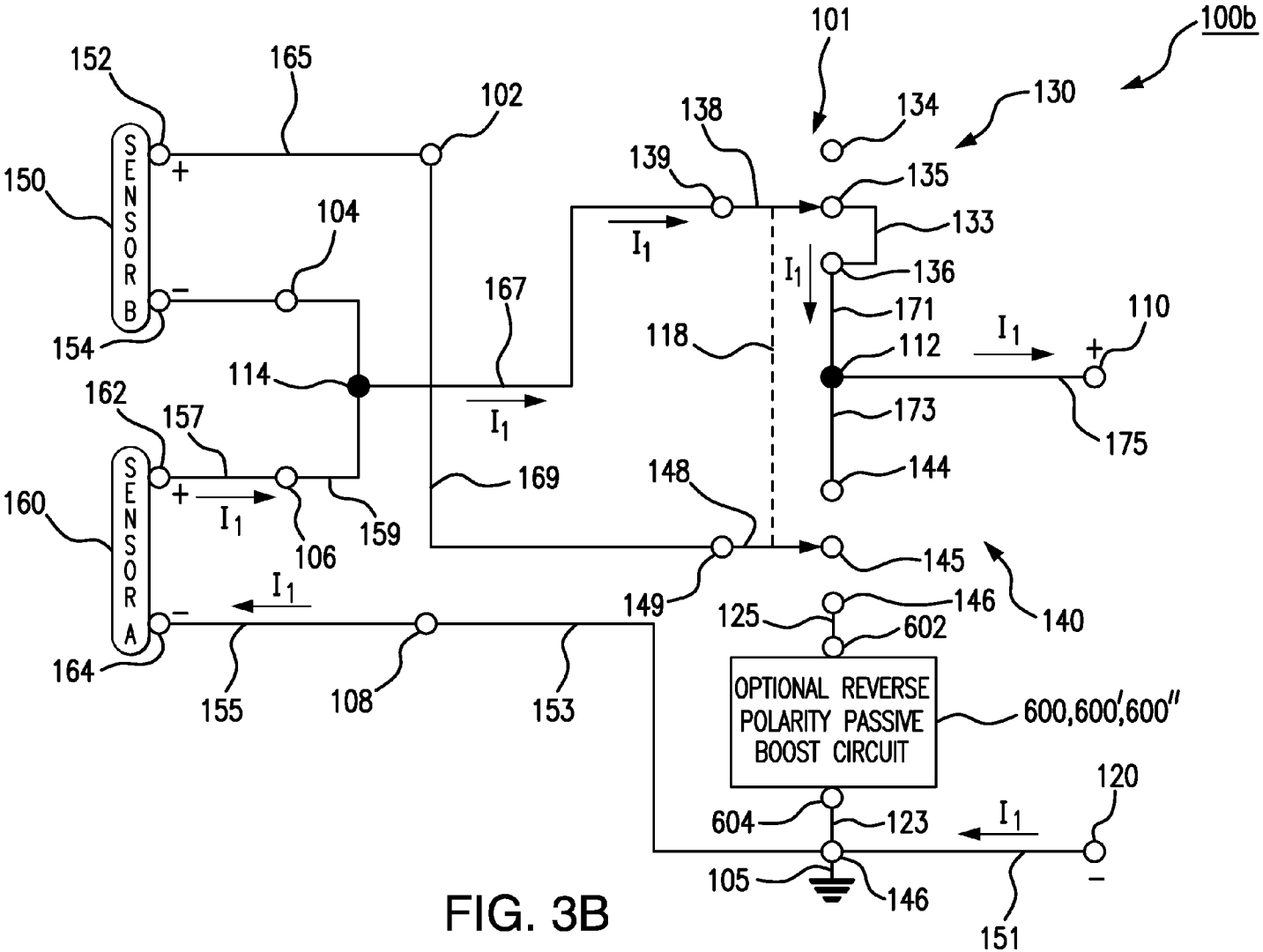
FIG. 3B is a schematic electrical diagram of the switched reversing configuration control with the alternate switch arrangement of FIG. 3A, adjusted for a single sensor configuration.
Figure 3C:
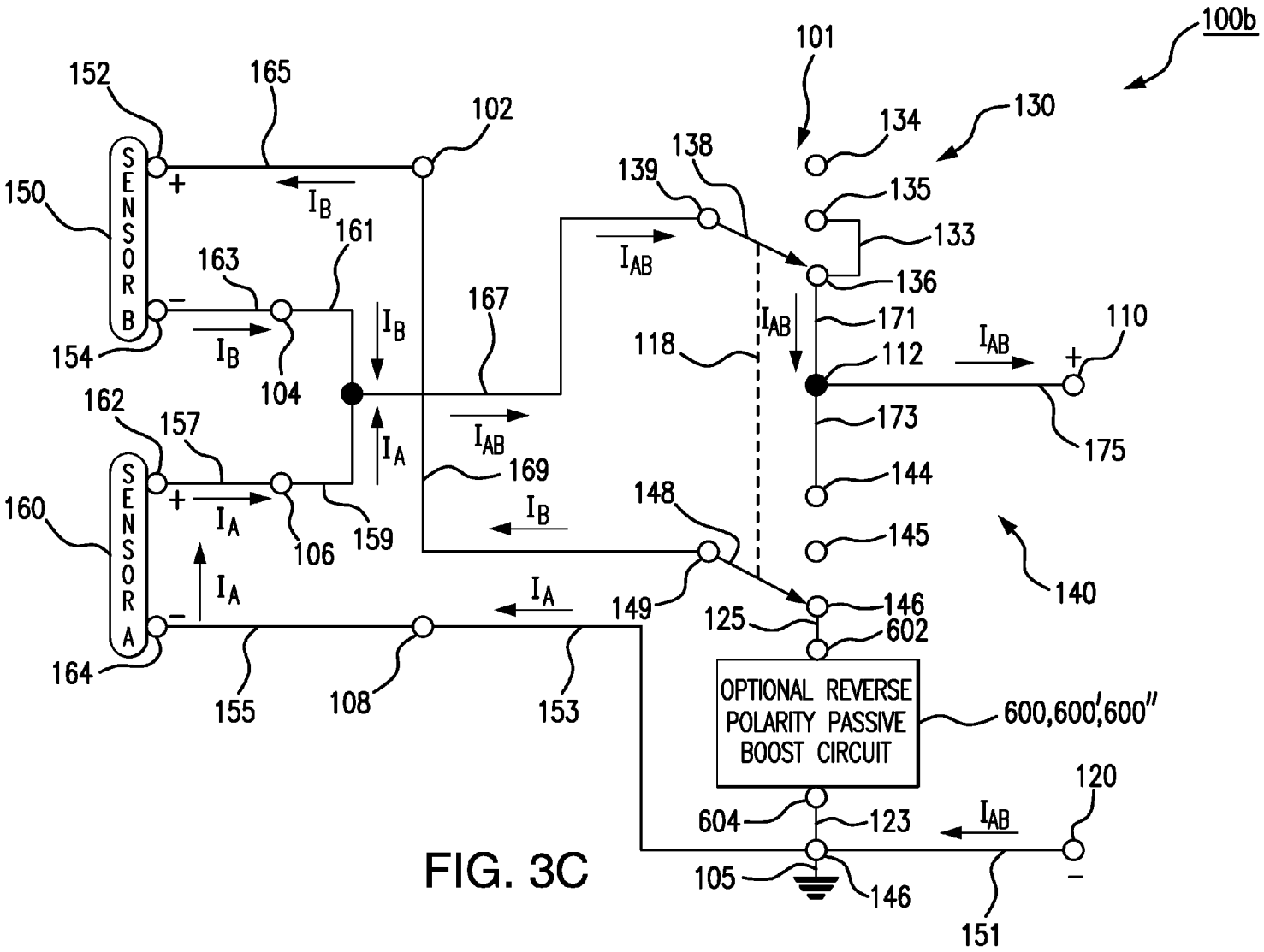
FIG. 3C is a schematic electrical diagram of the switched reversing configuration control with the alternate switch arrangement of FIG. 3A, adjusted for a parallel configuration of pickups of opposite polarity.
Figure 5A:
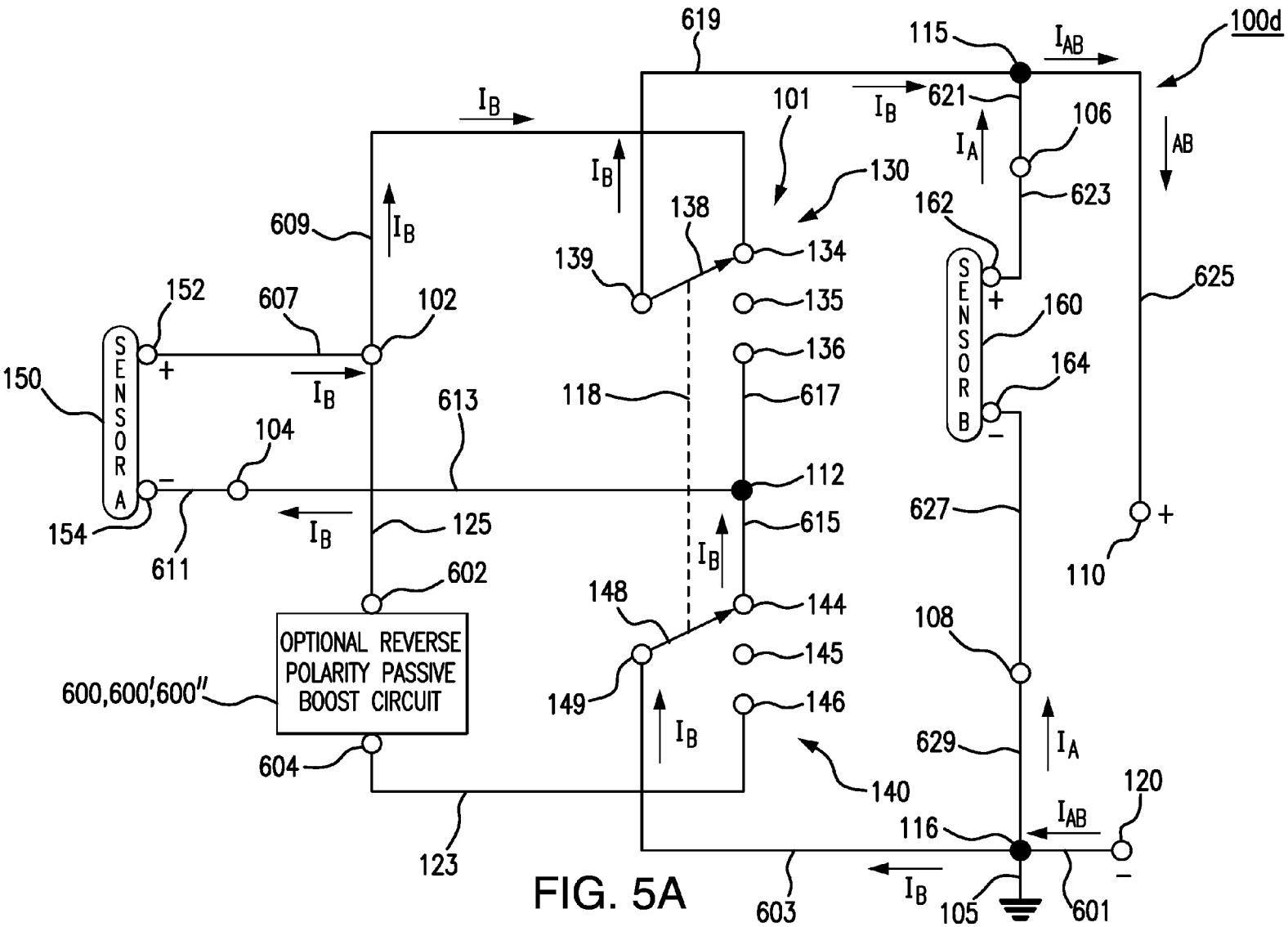
FIG. 5A. is a schematic electrical diagram of a further circuit arrangement of the switched reversing configuration control of the present invention adjusted for a parallel configuration of pickups of common polarity.
Figure 5B:
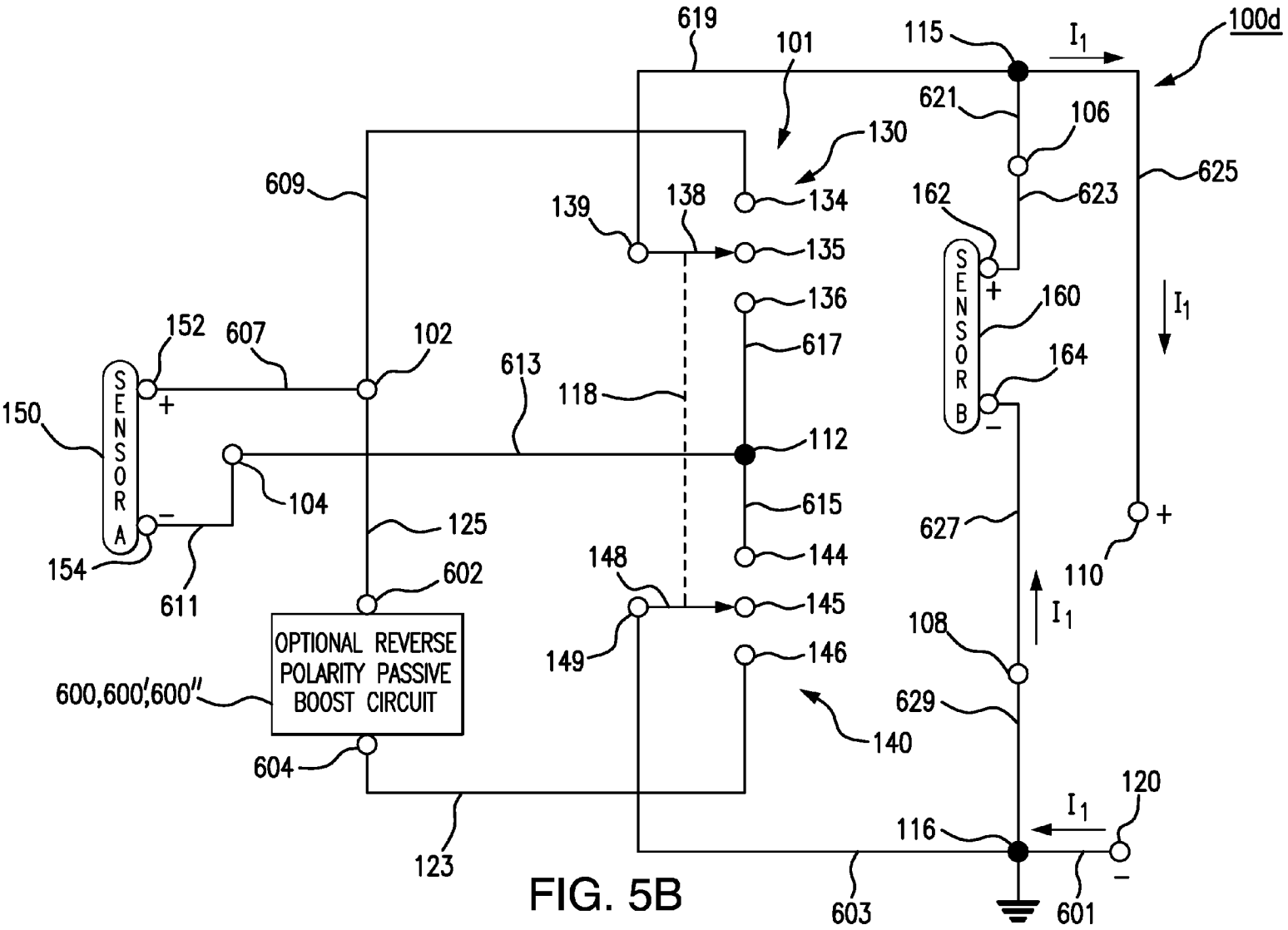
FIG. 5B is a schematic electrical diagram of the further circuit arrangement of the switched reversing configuration control of the present invention shown in FIG. 5A, adjusted for a single sensor configuration.
Figure 5C:
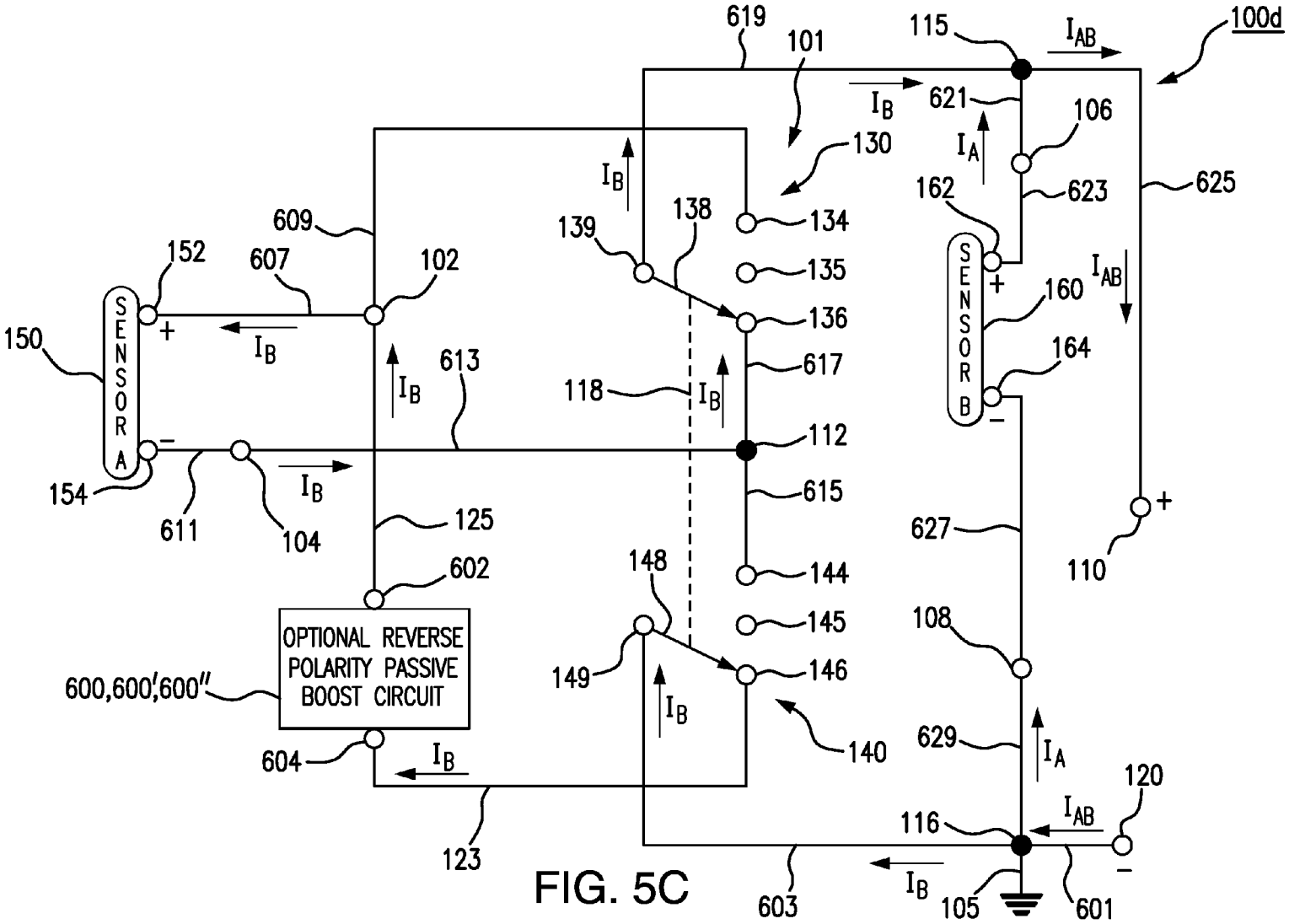
FIG. 5C is a schematic electrical diagram of the further circuit arrangement of the switched reversing configuration control of the present invention shown in FIG. 5A, adjusted for a parallel configuration of pickups of opposite polarity.

As can be seen in FIGS. 2C, 3C and 5C, in the reverse polarity configuration, the reverse polarity passive boost circuit 600, 600', 600" is coupled in series with the pickup sensor 150, which is preferably the pickup sensor closest to the bridge of the electric string musical instrument 700. The series combination of pickup sensor 150 and reverse polarity passive boost circuit 600, 600', 600" is connected in parallel with the pickup sensor 160. Reverse polarity passive boost circuit 600, 600', 600" introduces a series impedance with pickup sensor 150 and thereby reduces a percentage of the cancellation effect of pickup sensor 150, as a function of the resistive and/or reactive values of that impedance. As the pickup sensor closest to the neck outputs the lowest frequencies, it is typically the higher frequencies that a musician wishes to boost (reduce their subtractive effect) and therefore, the reactive impedance of reverse polarity passive boost circuit 600, 600', 600" is preferably capacitive. Where reverse polarity passive boost circuit 600, 600', 600" is employed to boost the lower frequency signals, as where it is coupled in series with the pickup sensor closest to the instrument's neck, the reactive impedance would be selected to be inductive.

Figure 6B:
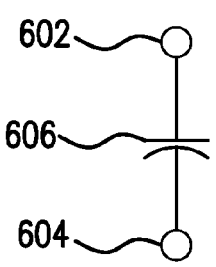
FIG. 6B is a schematic electrical diagram of the optional reverse polarity passive boost circuit of the present invention shown in FIGS. 2A, 2B, 2C, 3A, 3B, 3C, 5A, 5B, 5C and 8.

The reverse polarity passive boost circuit 600 is shown in FIG. 6B and includes a capacitor 606 coupled between the terminals 602 and 604. Capacitor 606 defines a high pass filter which passes signals with a frequency higher than a certain cutoff frequency and attenuates signals with frequencies lower than the cutoff frequency. The amount of attenuation and cutoff frequency depends on the value of the capacitor. In one working embodiment capacitor 606 having a capacitance in the range of 10 pf-67 pf have been successfully used.

Figure 6C:
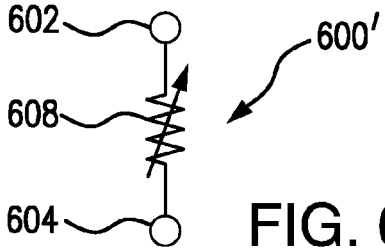
FIG. 6C is a schematic electrical diagram of another configuration of the optional reverse polarity passive boost circuit of the present invention shown in FIGS. 2A, 2B, 2C, 3A, 3B, 3C, 5A, 5B, 5C and 8.

As an alternative to a frequency dependent reverse polarity passive boost circuit, reverse polarity passive boost circuit 600', shown in FIG. 6C, provides a resistance 608 connected between the terminals 602 and 604. As the impedance of this circuit that is coupled in series with the pickup sensor 150 is resistive, reverse polarity passive boost circuit 600' thereby attenuates signals of all frequencies.

Hence, the subtractive effect of pickup sensor 150 is reduced for all signal frequencies, boosting the output voltage for signals across the frequency band produced by the electric string musical instrument 700. In one working embodiment, a resistance in the range of 10 kΩ-27 kΩ has successfully been used for the resistance 608. The resistance 608 may be a fixed resistor or variable resistor, such as trimmer type variable resistor, as the value of the resistance is not typically changed once set. Where a variable resistor is to used, it may be desirable to combine a fixed resistance of approximately 5 kΩ in series with a variable resistor to provide a minimal level of boost in the event that the variable resistor is set to substantially 0Ω.

Figure 6D:
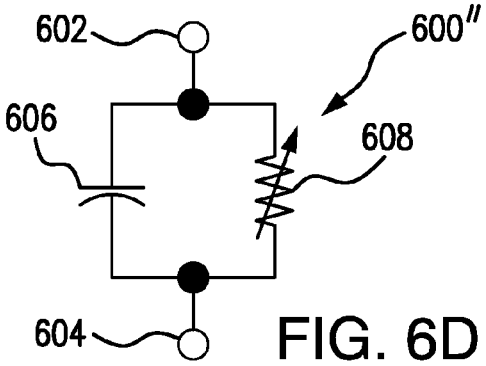
FIG. 6D is a schematic electrical diagram of a further configuration of the optional reverse polarity passive boost circuit of the present invention shown in FIGS. 2A, 2B, 2C, 3A, 3B, 3C, 5A, 5B, 5C and 8.

As yet another alternative to the reverse polarity passive boost circuit formed by a high pass filter or that formed by a non-frequency dependent attenuator, reverse polarity passive boost circuit 600" provides a tunable filter that permits adjustment of the ratio between high and low frequencies that are boosted via attenuation of the subtracted signal components of the output voltage from the paralleled pickup sensors. Reverse polarity passive boost circuit 600", as shown in FIG. 6D, includes a capacitor 606 coupled in parallel with a resistance 608 connected between the terminals 602 and 604. In this arrangement, the impedance of the resistance 608 predominates for signals in the lower frequencies (frequencies below the cutoff frequency), which provides a low impedance path for those signals compared to the impedance of the capacitor. For signals with frequencies above the cutoff frequency, these higher frequencies have a lower impedance path through the capacitor, bypassing the resistance 608. The cutoff frequency is determined as a function of the resistance and capacitance values selected. As in reverse polarity passive boost circuit 600 and 600', those signal frequencies attenuated represent the signal frequencies that are boosted at the output of switched reversing configuration control 100*a*, 100*b* or 100*d* with which it is employed.

In one working embodiment, capacitor 606 having a capacitance in approximate range of 2.7 pf-9.7 pf and resistance 608 having a resistance in the range of 10 kΩ-47 kΩ have been successfully used. Hereto, the resistance 608 may be a fixed resistor or variable resistor, such as trimmer type variable resistor, as the value of the resistance is not typically changed once set. Where a variable resistor is to be used, it may be desirable to combine a fixed resistance of approximately 5 kΩ in series with a variable resistor to provide a minimal level of boost in the event that the variable resistor is set to substantially 0Ω.

Switched reversing configuration control 100*b*, shown in FIGS. 3A, 3B and 3C, differs from the previously described switched reversing configuration control 100*a* only in the omission of the jumper conductor 143 connecting the switch terminals 144 and 145 of the switch pole 140. The functionality of switched reversing configuration control 100*b*, as illustrated in FIGS. 3A, 3B and 3C, is identical to that which was already described with respect to switched reversing configuration control 100*a*. Reference numerals in common with those in FIGS. 1, 2A, 2B, and 2C represent the same elements. In FIGS. 3A and 3C, it is easy to see why the omission of the jumper conductor 143 has no effect on the configuration provided at each of the opposing ends of the mechanical travel of the displaceable contacts 138 and 148. As for the setting of the displaceable contacts 138 and 148 of switch poles 130 and 140 at the respective intermediate positions thereof for connection to respective terminals 135 and 145, as shown in FIG. 3B, perceiving that the functionally remains the same is not immediately obvious. It will be recalled that when the displaceable contacts 138 and 148 are at the respective intermediate positions to connect to respective terminals 135 and 145 of switched reversing configuration control 100*a*, pickup sensor 150 is short circuited. Whereas, in switched reversing configuration control 100*b*, absent the jumper conductor 143 switch pole 140 provides an open circuit across the output of pickup sensor 150, isolating pickup sensor 150. Switched reversing configuration control 100*b* is particularly advantageous for use with active type pickup sensors. An active type pickup sensor incorporates a preamplifier to raise the level of the signals output therefrom and may not include short circuit protection, which would otherwise be required with use of switched reversing configuration control 100*a* and obviated by switched reversing configuration control 100*b*.

The polarity of either of pickup sensors 150 or 160 can be reversed in their connection to switched reversing configuration control 100*b*. Thus, the positive terminal 152 of pickup sensor 150 can be connected to input terminal 104 and the negative terminal 154 thereof correspondingly connected to input terminal 102. Alternately, the positive terminal 162 of pickup sensor 160 can be connected to input terminal 108 and the negative terminal 164 thereof correspondingly connected to input terminal 106. With this alternative connection scheme for one of the pickup sensors, switched reversing configuration control 100*b* provides the pickup sensors 150 and 160 in a series configuration with opposing polarity at the first end of the mechanical travel of displaceable contacts 138, 148; only the pickup sensor 160 output at the intermediate position of the mechanical travel of displaceable contacts 138, 148; and provides the pickup sensors 150 and 160 in a parallel configuration with like polarity at the second end of the mechanical travel of displaceable contacts 138, 148. Adding the reverse polarity passive boost circuit 600, 600', 600", as shown in FIGS. 6B, 6C and 6D, to switched reversing configuration control 100*b* functions by reducing the subtractive effect of the reversed pickup sensor for some or all of the signal frequencies being transduced to thereby increase the output voltage for the combined pickup sensors, as previously described.

Figure 4A:
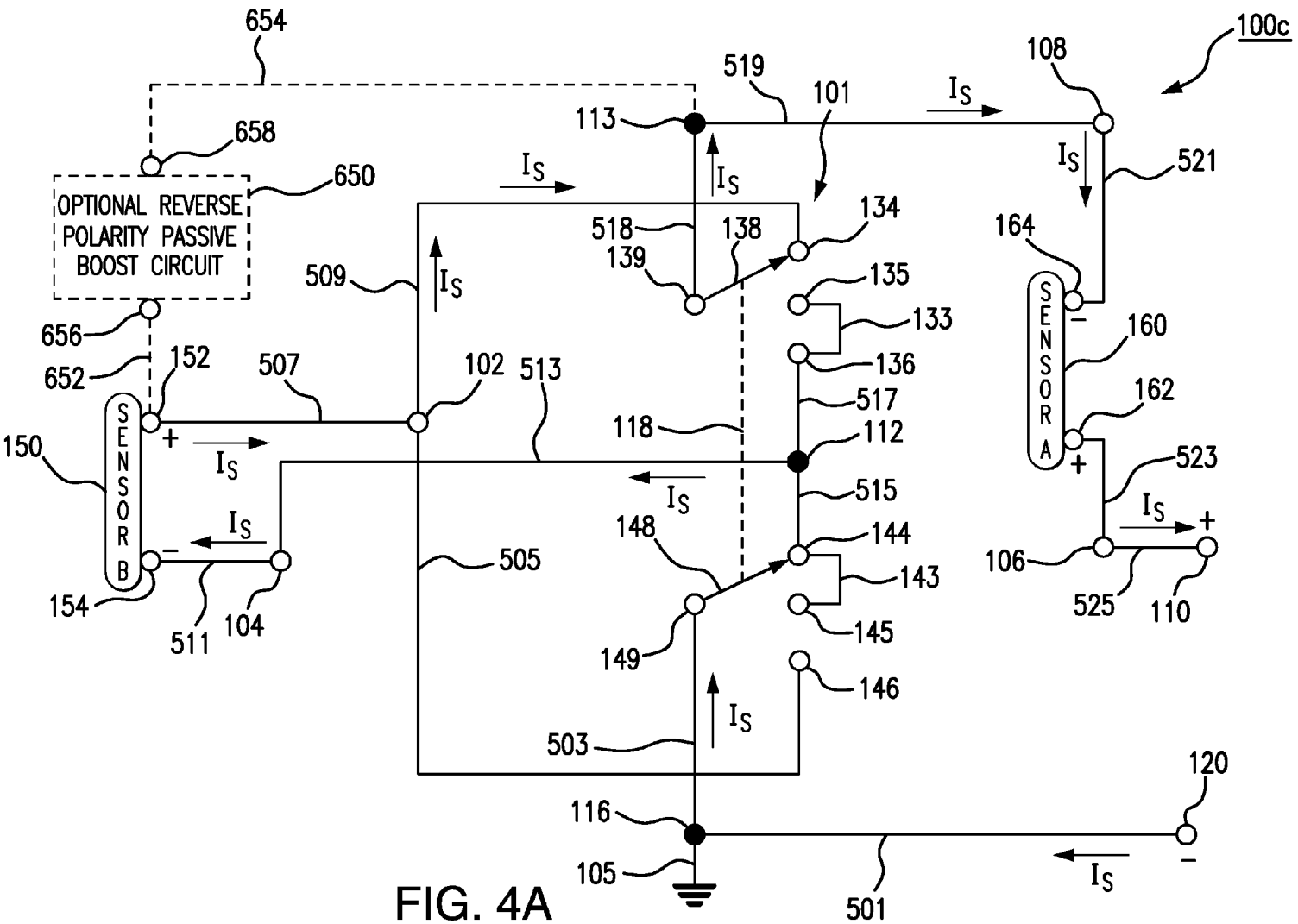
FIG. 4A is a schematic electrical diagram of another circuit arrangement of the switched reversing configuration control of the present invention adjusted for a series configuration of pickups of common polarity.
Figure 4B:
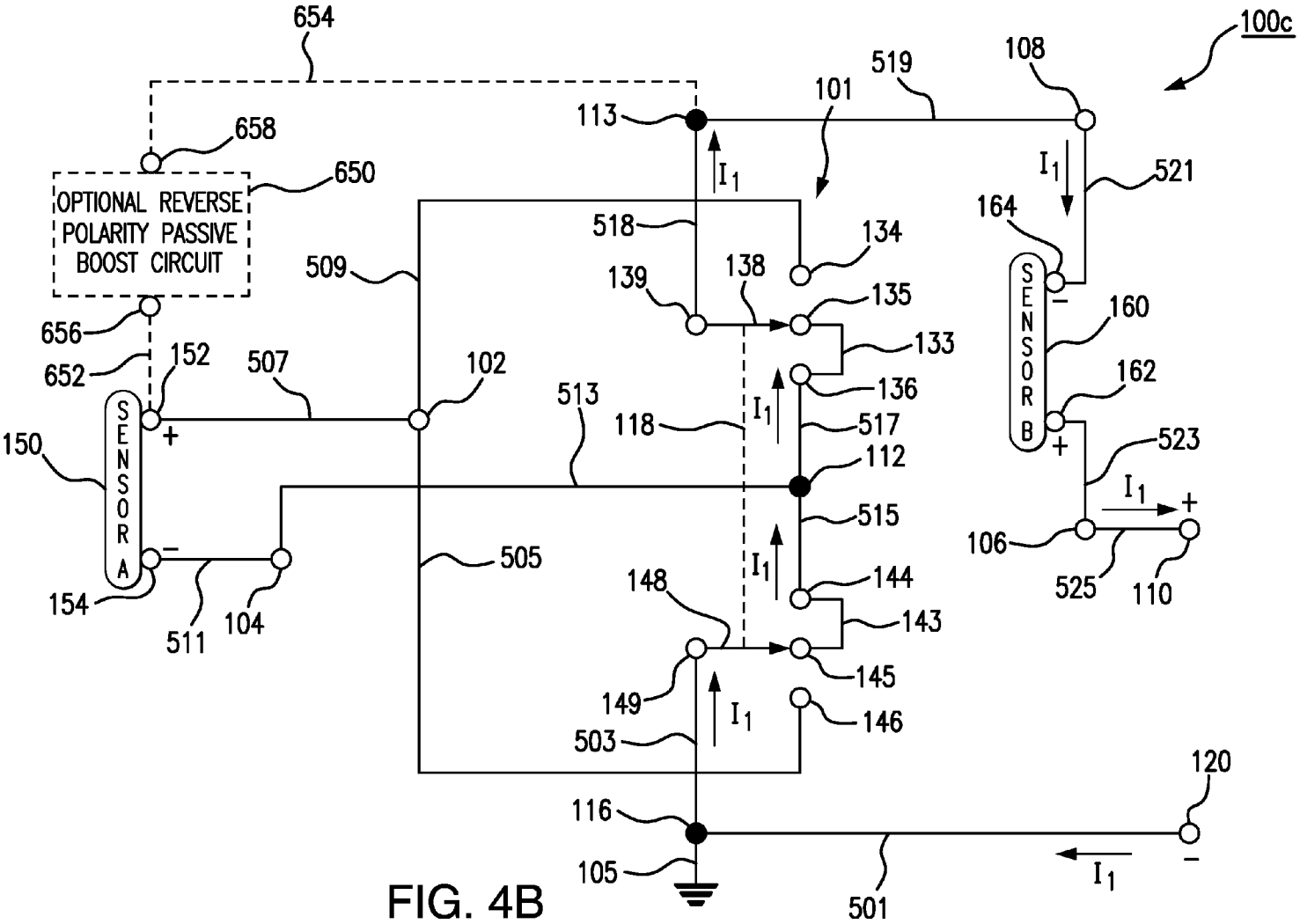
FIG. 4B is a schematic electrical diagram of the other circuit arrangement of the switched reversing configuration control of the present invention shown in FIG. 4A, adjusted for a single sensor configuration.
Figure 4C:
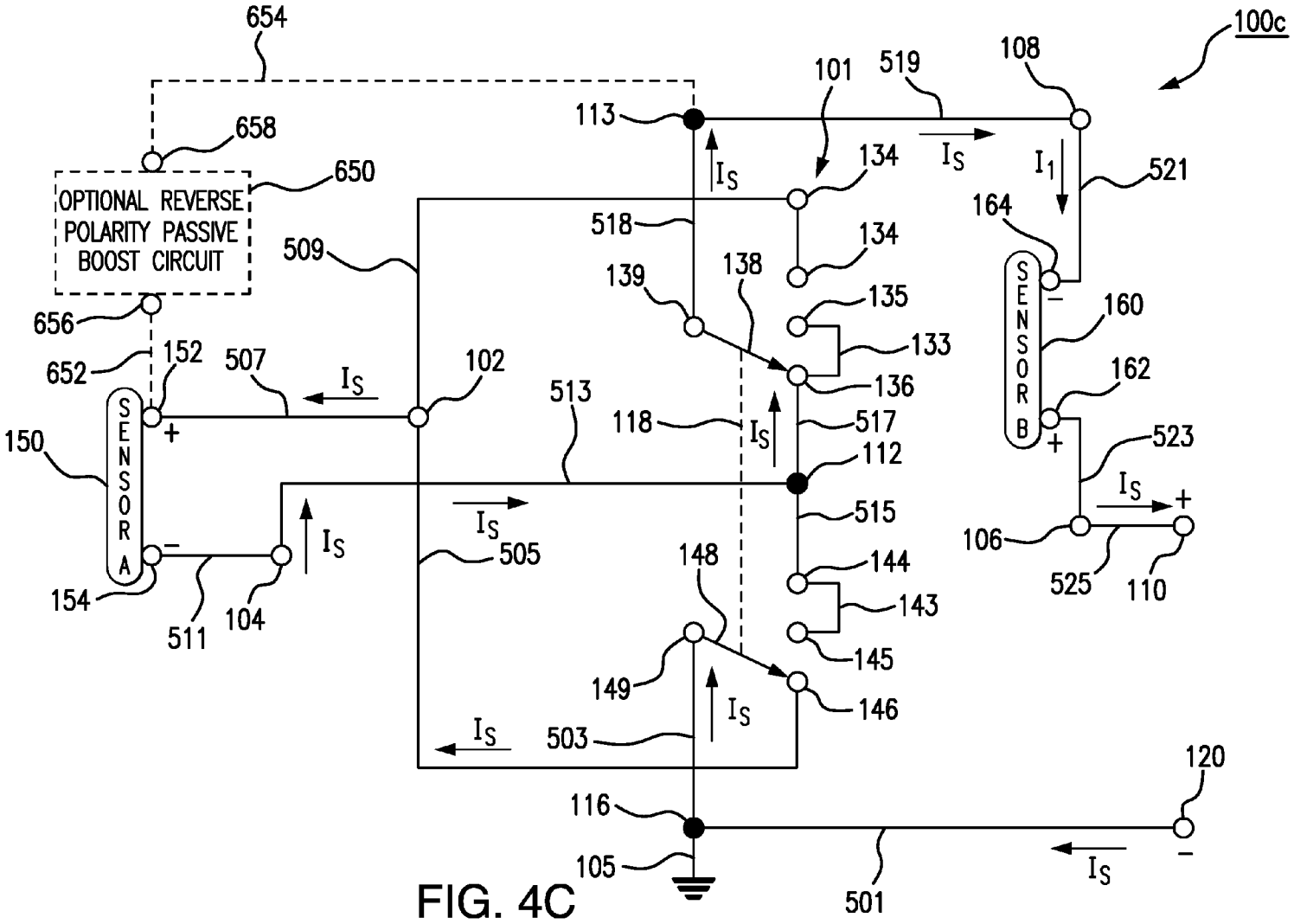
FIG. 4C is a schematic electrical diagram of the other circuit arrangement of the switched reversing configuration control of the present invention shown in FIG. 4A, adjusted for a series configuration of pickups of opposite polarity.

The following connections apply to the switched reversing configuration control 100*c* shown in each of FIGS. 4A, 4B and 4C. Reference numerals in common with those in FIGS. 1, 2A, 2B, 2C, 3A, 3B, and 3C represent the same elements. Negative output terminal 120 is connected by conductor 501 to node 116, to which the ground reference 105 is also connected, and node 116 is further connected to the displaceable contact terminal 149 of switch pole 140 by conductor 503. The terminal 146 of switch pole 140 is connected to the input terminal 102 by conductor 505 and conductor 507 connects the positive terminal 152 of pickup sensor 150 to the input terminal 102. The input terminal 102 is also coupled to terminal 134 of switch pole 130 by the conductor 509. The negative terminal 154 of pickup sensor 150 is connected to input terminal 104 by conductor 511, which is in turn connected to node 112 by conductor 513. Node 112 is connected to terminal 144 of switch pole 140 by conductor 515 and connected to terminal 136 of switch pole 130 by conductor 517. Switch terminal 136 is connected to switch terminal 135 of switch pole 130 by the jumper conductor 133 and the switch terminal 144 is connected to switch terminal 145 of switch pole 140 by the jumper conductor 143.

The displaceable contact terminal 139 is connected by conductor 518, node 113 and conductor 519 to input terminal 108. The negative terminal 164 of pickup sensor 160 is connected to input terminal 108 via conductor 521. The opposing positive terminal 162 of pickup sensor 160 is connected by conductor 523 to input terminal 106, which in turn is connected by conductor 525 to positive output terminal 110. As will be described in following paragraphs, switched reversing configuration control 100*c* may optionally include a reverse polarity passive boost circuit 650. When employed, the reverse polarity passive boost circuit 650 is connected between the positive pickup sensor terminal 152 and the node 113, with a conductor 652 connected between the positive pickup sensor terminal 152 and a terminal 656 of the reverse polarity passive boost circuit 650 and a conductor 654 connected between the terminal 658 of the circuit 650 and node 113.

The functioning of switched reversing configuration control 100*c* will now be described, beginning with the displaceable contacts 138, 148 of the multipole switch 101 being at a first end of their respective mechanical travel, as shown in FIG. 4A. Starting with the current $I_S$ flowing into the negative output terminal 120. The current $I_S$ flows to the displaceable contact terminal 149 of switch pole 140 through conductor 501, node 116 and conductor 503. The current $I_S$ flows from displaceable contact terminal 149 to input terminal 104 and pickup sensor 150 negative terminal 154 through the displace able contact 148, the switch terminal 144, conductor 515, node 112 and conductor 513 to input terminal 104 and then through conductor 511. No current flows from node 112 to switch terminal 136, as that circuit path is open circuited by the position of the displaceable contact 138 of switch pole 130.

From terminal 154 of pickup sensor 150, the current $I_S$ flows through the pickup sensor 150 to the positive terminal thereof 152 and through the conductor 507 to input terminal 102. The current Is flows from input terminal 102 to the terminal 134 of switch pole 130 via the conductor 509. As switch terminal 146 of switch pole 140 is open, no current flows from input terminal 102 through conductor 505 to terminal 146. From switch pole terminal 134, the current $I_S$ flows to input terminal 108 through displaceable contact 138 to terminal 139 and through conductor 518, node 113 and conductor 519. The current $I_S$ flows from input terminal 108 to the negative terminal 164 of pickup sensor 160 via conductor 521 and through the pickup sensor 160 to the positive terminal 162 thereof. The current $I_S$ flows from the positive terminal 162 to input terminal 106 through conduct 523 and flows therefrom to the positive output terminal 110 through conductor 525. Thus, it can be seen that the same current $I_S$ flows through both pickup sensors 150 and 160, with the positive terminal of sensor 150 connected to the negative terminal of sensor 160. Accordingly, the pickup sensors are connected with like polarity in series. As previously discussed, when pickup sensors are coupled in series, the voltages generated in the sensors is additive, but provide a higher impedance to higher frequency audio signals and hence they are said to provide a fuller and stronger sound due to the low pass filtering characteristic of that configuration.

As shown in FIG. 4B, the switch poles 130, 140 of multipole switch 101 are set at the respective intermediate switch terminal positions 135, 145. In that position of multipole switch 101, a current $I_1$ flows into the negative output terminal 120 to node 116 through conductor 501 and through conductor 503 to the displaceable contact terminal 149 of switch pole 140. The current $I_1$ flows from terminal 149 through displaceable contact 148 to terminal 144 of switch pole 140 via the jumper conductor 143. From terminal 144, the current $I_1$ flows to the switch pole terminal 136 through conductor 515, node 112 and conductor 517. As a result of the positive terminal 152 being connected to open switch terminals 134 and 146 via conductor 507, input terminal 102 and conductors 509 and 505, pickup sensor 150 is isolated from the current path and no current flows therethrough. The current $I_1$ flows from terminal 136 through the jumper conductor 133 to switch terminal 135 and through the displaceable contact 138 to the displaceable contact terminal 139 of switch pole 130. From terminal 139, the current $I_1$ flows to input terminal 108 through conductor 518, node 113 and conductor 519. From input terminal 108, the current $I_1$ flows through pickup sensor 160, via conductor 521 and negative pickup sensor terminal 164, and then to positive pickup sensor terminal 162. The current $I_1$ flows from positive pickup sensor terminal 162 to the positive output terminal 110 via the conductor 523, input terminal 106 and conductor 525. Hence, at the intermediate position of mechanical travel of switch poles 130 and 140, only the output signals from the pickup sensor 160 are output at terminals 110 and 120 to provide the conventional single sensor full frequency spectrum sound.

As shown in FIG. 4C, the switch poles 130, 140 are set with the displaceable contacts 138, 148 positioned at the opposing second end of their respective mechanical travel compared with that depicted in FIG. 4A. Looking at the current $I_S$ flowing into the negative output terminal 120, such flows to the displaceable contact terminal 149 of switch pole 140 through conductor 501, node 116 and conductor 503. The current $I_S$ flows from displaceable contact terminal 149 to input terminal 102 and therefrom to pickup sensor 150 positive terminal 152 through the displace able contact 148 of switch pole 140, terminal 146 thereof, conductor 505 to input terminal 102 and then through conductor 507.

From the positive pickup sensor terminal 152, the current $I_S$ flows through the pickup sensor 150 to the negative terminal thereof 154 and through the conductor 511 to input terminal 104. The current Is flows from input terminal 104 to the node 112 via the conductor 513. As a result of the switch terminal 144 and 145 of switch pole 140 being open circuited, no current flows from node 112 through conductor 515 to terminal 144. Therefore, from node 112, the current $I_S$ flows to switch pole terminal 136 through conductor 517, and therefrom through displaceable contact 138 to terminal 139. The current $I_S$ flows from displaceable contact terminal 139 to input terminal 108 through conductor 518, node 113 and conductor 519. The current $I_S$ continues from input terminal 108 to the negative terminal 164 of pickup sensor 160 via conductor 521 and through the pickup sensor 160 to the positive terminal 162 thereof. The current $I_S$ flows from the positive terminal 162 to input terminal 106 through conductor 523 and flows therefrom to the positive output terminal 110 through conductor 525. Thus, it can be seen that the same current $I_S$ flows through both pickup sensors 150 and 160, with the negative terminal of pickup sensor 150 connected to the negative terminal of pickup sensor 160. Accordingly, the pickup sensors are connected in series with the polarity of one pickup sensor with respect to the other being reversed, which results in subtraction of signals (a difference signal) generated by the two sensors, as a function of amplitude and phase, as previously discussed.

As can be seen in FIG. 4C, where switched reversing configuration control 100*c* is set in the reverse polarity configuration, the reverse polarity passive boost circuit 650 may optionally be connected between the positive terminal 152 of pickup sensor 150 and node 113. When employed, reverse polarity passive boost circuit 650 has one terminal 656 connected to the positive terminal 152 of pickup sensor 150 by a conductor 652, and a terminal 658 connected to the node 113 by a conductor 654. By that arrangement, reverse polarity passive boost circuit 650 is coupled in parallel with the pickup sensor 150, which is preferably the pickup sensor closest to the bridge of the electric string musical instrument 700. Thus, the parallel combination of pickup sensor 150 and reverse polarity passive boost circuit 650 is coupled in series with pickup sensor 160, with the polarity of one pickup sensor being reversed with respect to the polarity of the other pickup sensor. Those signals that pass through the paralleled reverse polarity passive boost circuit 650, reduce those that are combined subtractively by the opposite polarity pickup sensors, thereby boosting the output voltage for those signals.

Figure 7:
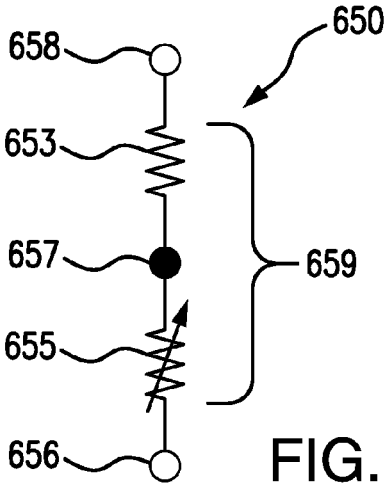
FIG. 7 is a schematic electrical diagram of the optional reverse polarity passive boost circuit of the present invention shown in FIGS. 4A, 4B and 4C.

Referring to FIG. 7, there is shown reverse polarity passive boost circuit 650 which includes a resistance 659 connected between the terminals 656 and 658 of reverse polarity passive boost circuit 650. While resistance 659 may be a fixed resistance, the best results have been achieved in working embodiments using a variable resistance in series with a fixed resistance to set the degree of signal bypass without the potential for reducing the bypass impedance (in the form of resistance) to the degree that the pickup sensor is, for practical purposes, short circuited and thereby substantially negating the reverse polarity effect. Accordingly, the resistance 659 includes a fixed resistor 653 having a value with in the range of 20 kΩ-50 kΩ connected between the terminal 658 and a node 657, and a variable resistor 655 having a value with in the range of 250 kΩ-500 kΩ connected between the node 657 and the terminal 656.

The following connections apply to the switched reversing configuration control 100*d* shown in each of FIGS. 5A, 5B and 5C. Reference numerals in common with those in FIGS. 1, 2A, 2B, 2C, 3A, 3B, 3C, 4A, 4B, and 4C represent the same elements. Negative output terminal 120 is connected by conductor 601 to node 116, to which the ground reference 105 is also connected, and node 116 is further connected to the displaceable contact terminal 149 of switch pole 140 by conductor 603. The terminal 146 of switch pole 140 is connected to terminal 602. Between terminals 602 and 604, the jumper conductor 601 (FIG. 6A) may be connected, or alternately the optional reverse polarity passive boost circuit 600, 600', 600" (FIGS. 6B, 6C, 6D) may be connected. The terminal 602 is connected to input terminal 102 by conductor 125, which is in turn connected by conductor 607 to the positive terminal 152 of pickup sensor 150. The input terminal 102 is also coupled to terminal 134 of switch pole 130 by the conductor 609. The negative terminal 154 of pickup sensor 150 is connected to input terminal 104 by conductor 611, which is in turn connected to node 112 by conductor 613. Input terminal 104 is connected to node 112 by conductor 113, and node 112 is connected to terminal 144 of switch pole 140 by conductor 615 and connected to terminal 136 of switch pole 130 by conductor 617. The displaceable contact terminal 139 is connected by conductor 619 to node 115. Node 115 is connected to both positive output terminal 110, by conductor 625, and input terminal 106 by conductor 621. The positive terminal 162 of pickup sensor 160 is connected to input terminal 106 by conductor 623. The opposing negative terminal 164 of pickup sensor 160 is connected to input terminal 108, by conductor 627, which in turn is connected by conductor 629 to node 116.

Switched reversing configuration control 100*d* utilizes multipole switch 101 having at least switch poles 130 and 140 that are mechanically coupled for concurrent displaceable contact movement, as is conventional for multipole switches, illustrated by the coupling line 118. The functioning of switched reversing configuration control 100*d* will now be described, beginning with the displaceable contacts 138, 148 being at a first end of their respective mechanical travel, as shown in FIG. 5A. Beginning at negative output terminal 120, the current $I_{AB}$ flows to node 116 through the conductor 601. At node 116 the current $I_{AB}$ divides into a current $I_A$ flowing to input terminal 108 via conductor 629 and a current $I_B$ flowing to displaceable contact terminal 149 of switch pole 140 through the conductor 603. The current $I_A$ flows from input terminal 108 to the negative terminal 164 of pickup sensor 160 via conductor 627, and through that pickup sensor 160 to positive pickup sensor terminal 162. From terminal 162, the current $I_A$ flows to the node 115 through conductor 623, input terminal 106 and the conductor 621.

The current $I_B$ flows from displaceable contact terminal 149 to node 112 via the displaceable contact 148, switch terminal 144 and conductor 615. As should now be well understood, no current flows from node 112 to the terminal 136 which is an open circuit. The current $I_B$ flows from node 112 to the negative terminal 154 of pickup sensor 150 via the conductor 613, input terminal 104 and the conductor 611. The current $I_B$ flows through pickup sensor 150 to the positive terminal 152 thereof and from there through input terminal 102 and conductor 609 to terminal 134 of switch pole 134. As the switch contact 146 of switch pole 140 is open circuited in the this first switch position, no current flows between switch terminal 146 and input terminal 102. From terminal 134, the current $I_B$ flows through the displaceable contact 138, terminal 139 and conductor 619 to the node 115 where it is combined with the current $I_A$ to form the current $I_{AB}$. The current $I_{AB}$ flows from node 115 through the conductor 625 to the positive output terminal 110. As the negative terminals 154 and 164 of the corresponding pickup sensors 150 and 160 are electrically coupled in common to the negative output terminal 120, and the corresponding positive terminals 152 and 162 are likewise electrically coupled in common to the positive output terminal 110, such defines a parallel circuit configuration of pickup sensors 150 and 160. Further, it can be seen that both pickup sensors 150 and 160 have like polarity. Thus, the parallel arrangement of pickup sensors 150 and 160 with like polarity produces a brighter sound due to the known effect of reduced high frequency impedance compared to a series configuration thereof. The parallel configuration of pickup sensors also results in a lower voltage than that produced by series coupled pickup sensors.

As shown in FIG. 5B, the displaceable switch contacts 138, 148 are respectively set at the intermediate position switch terminal 135, 145. With the displaceable contacts 138 and 148 at that position, there are no current paths connected to the pickup sensor 150, and thus, the pickup sensor 150 is isolated from the output terminals 110 and 120. A current $I_1$ flows into the negative output terminal 120 to node 116 through conductor 601 and through conductor 629 to the input terminal 108. No current flows from node 116 through conductor 603 due the displaceable contact 148 of switch pole 140 being connected to the open circuited switch terminal 145. From input terminal 108 the current $I_1$ flows through pickup sensor 160 via conductor 627, and negative pickup sensor terminal 164, to flow to positive pickup sensor terminal 162. The current $I_1$ flows from terminal 162 to input terminal 106 via conductor 623, and therefrom to node 115 via conductor 621. No current flows to or from node 115 through conductor 619 due the displaceable switch contact 130 of switch pole 130 being connected to the open circuited switch contact 135. From node 115, the current $I_1$ flows to positive output terminal 110 through the conductor 625. Thus, at the intermediate switch position of the displaceable switch contacts 138 and 148 of the corresponding switch poles 130 and 140 of switched reversing configuration control 100*d*, only the output signals from the pickup sensor 160 are output at terminals 110 and 120 to provide the conventional single sensor full frequency spectrum sound.

Referring now to FIG. 5C, the multipole switch 101 is set with the displaceable contacts 138, 148 positioned at the opposing second end of their respective mechanical travel compared with that shown in FIG. 5A. Beginning at negative output terminal 120, the current I flows to node 116 via conductor 601. At node 116 the current $I_{AB}$ divides into a current $I_A$ that flows to the node 115 as was previously described with respect to FIG. 5A. and a current $I_B$ flowing to displaceable contact terminal 149 of switch pole 140 through the conductor 603. The current $I_B$ flows from displaceable contact terminal 149 through the displaceable contact 148 to terminal 146 and through conductor 123 to terminal 604. Terminal 604 is connected to the input terminal 102, either through the conductor 601 (FIG. 6A), terminal 602 and conductor 125 or through the optional reverse polarity passive boost circuit 600, 600', 600", terminal 602 and conductor 125.

The current $I_B$ flows from input terminal 102 to the positive terminal 152 of pickup sensor 150 via the conductor 607, while no current flows from input terminal 102 through conductor 609 to the open circuited switch terminal 134 of switch pole 130. The current $I_B$ flows through pickup sensor 150, to the negative terminal 154 thereof, then through conductor 611 to input terminal 104, and therefrom through conductor 613 to node 112. The current $I_B$ flows from node 112 to terminal 136 of switch pole 130 through conductor 617. No current flows from node 112 to the terminal 144 via conductor 615, as such is open circuited. Therefore, the current $I_B$ flows to the displaceable contact terminal 139 through the displaceable contact 138. From, terminal 139 the current $I_B$ flows through conductor 619 to the node 115 where it is combined with the current $I_A$ to form the current $I_{AB}$. The current $I_{AB}$ flows through the conductor 625 to the positive output terminal 110. As the negative terminal 154 of pickup sensor 150 is electrically coupled in common with the positive terminal 162 of pickup sensor 160 to positive output terminal 110, and the positive terminal 152 of pickup sensor 150 is electrically coupled in common with the negative terminal 164 of pickup sensor 160 to the negative output terminal 120, such defines a parallel circuit configuration of pickup sensors 150 and 160, but with the pickup sensors being connected with the polarity of one pickup sensor being reversed with respect to the polarity of the other. Hence, this parallel configuration of pickup sensors results in subtraction of signals generated by the two sensors, as a function of their amplitude and phase, just as results in the series pickup sensor configurations with the sensors having opposing polarities, as previously discussed. Hereto, the reverse polarity passive boost circuit 600, 600', 600", as shown in FIGS. 6B, 6C and 6D, can be added to switched reversing configuration control 100*d*. As previously described, reverse polarity passive boost circuit 600, 600', 600" functions to reduce the subtractive effect of the reversed pickup sensor for some or all of the signal frequencies being transduced, and thereby increases the output voltage for the combined pickup sensors.

Figure 8:
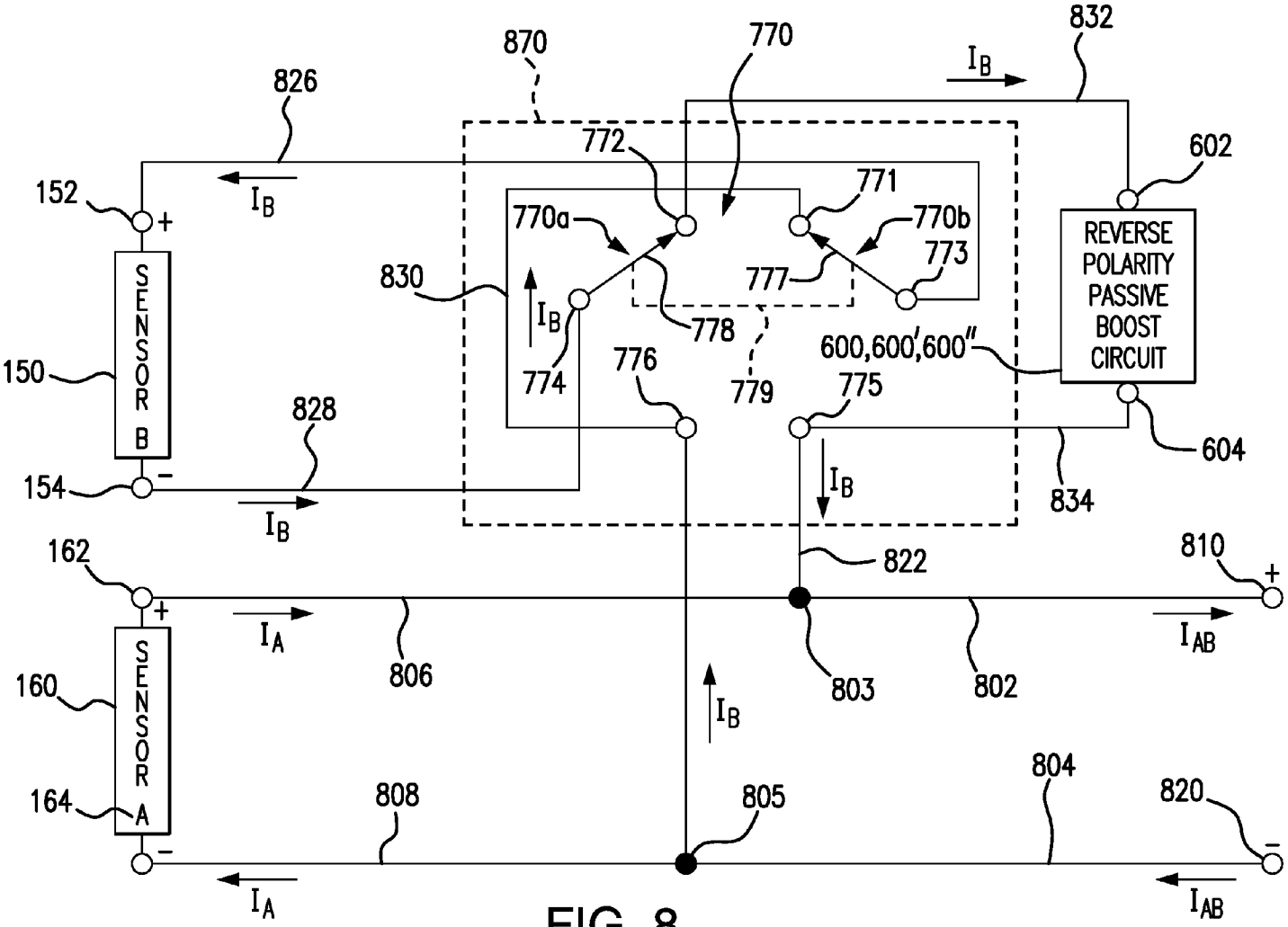
FIG. 8 is a schematic electrical diagram of the optional reverse polarity passive boost circuit of FIG. 6B, 6C or 6D of the present invention incorporated into a known multipole switch phase reversal control circuit.

Turning now to FIG. 8, there is shown a conventional pickup sensor reversing circuit 870 connected for connecting the pickup sensor A 160 and pickup sensor B 150 in parallel relationship in either like polarity or reversed polarity, and to which the reverse polarity passive boost circuit 600, 600', 600" has been connected. Thus, in the reverse polarity configuration, reverse polarity passive boost circuit 600, 600', 600" (the switch position depicted in the figure) is coupled in series with the pickup sensor 150 and that series combination is coupled in parallel with the pickup sensor 160. As shown, the reverse polarity passive boost circuit 600, 600', 600" can be incorporated in electric string instruments with conventional pickup sensor reversing circuits to reduce the subtractive effect of the reversed pickup sensor for some or all of the signal frequencies being transduced, and thereby increases the output voltage for the combined pickup sensors.

As is common in the art, pickup sensor reversing circuit 870 includes a two position switch 770 that has two poles 770*a* and 770*b*. Switch 770 used in pickup sensor reversing circuit 870 may be a two pole, two position slide or rotary type switch or a double pole, double throw (DPDT) toggle type switch. The pole 770*a* includes a displaceable contact terminal 774 to which the displaceable contact 778 is electrically coupled. The displaceable contact 778 is switchable between electrical connection to either the switch terminal 772 or the switch terminal 776. Similarly, the pole 770*b* includes a displaceable contact terminal 773 to which the displaceable contact 777 is electrically coupled. The displaceable contact 777 is switchable between electrical connection to either the switch terminal 771 or the switch terminal 775. The displaceable contacts 778 and 777 are mechanically coupled, as indicated by the coupling line 779, for concurrent displacement. As an alternative to the two position switch 770, it is known to use ganged potentiometers in place of such switches. A potentiometer can serve as a switching device by selection of the potentiometers resistance so that it provides a negligible current flow through that resistance when the displaceable contact thereof is connected to one end of that resistance. When potentiometers are ganged, their respective displaceable contacts are mechanically coupled for concurrent displacement and each potentiometer functions as one switch pole. Thus, where the conventional pickup sensor reversing circuit 870 utilizes a pair of ganged potentiometers in place of the two position switch 770, the connections and functioning of reverse polarity passive boost circuit 600, 600', 600" remains the same.

Beginning at negative output terminal 820, the current $I_{AB}$ flows to node 805 via conductor 804. At node 805 the current $I_{AB}$ divides into the current $I_A$ that flows from node 805 through conductor 808 to the negative terminal 164 of pickup sensor A 160, and a current $I_B$ flowing to the open switch terminal 776 of the switch pole 770*a* through the conductor 824. The current $I_A$ flows through the pickup sensor 160 to the positive pickup sensor terminal 162 and therefrom to the node 803 via the conductor 806. The current $I_B$ flows from switch terminal 776 of pole 770*a* through conductor 830 to switch terminal 771 and through the displaceable contact 777 to displaceable contact terminal 773. From the displaceable contact terminal 773, the current $I_B$ through conductor 826 to the positive terminal 604 of pickup sensor B 150 to flow through the pickup sensor 150 to the negative pickup sensor terminal 154.

The current $I_B$ flows from the negative pickup sensor terminal 154 to the displaceable contact terminal 774 of switch pole 770*a* through the conductor 828. From the displaceable contact terminal 774, the current $I_B$ flows through displace able contact 778 to the switch terminal 772 and therefrom to the terminal 602 of reverse polarity passive boost circuit 600, 600', 600" via conductor 332. The reverse polarity passive boost circuit 600, 600', 600" is shown in FIGS. 6B, 6*c* and 6D, and has has been described in preceding paragraphs. The current $I_B$ exits from the reverse polarity passive boost circuit 600, 600', 600" via the terminal 604 and flows to the open switch terminal 775 through the conductor 834. From the switch terminal 775, the current $I_B$ flows through the conductor 822 to node 803 where the current $I_B$ combines with the current $I_A$ to form the current $I_{AB}$. The current $I_{AB}$ flows from node 803 through the conductor 802 to the positive output terminal 810, completing the current path through the circuit.

Thus, it can be seen that in the switch position depicted that the pickup sensor 150 is connected in series with the reverse polarity passive boost circuit 600, 600', 600" and that series circuit is coupled in parallel with pickup sensor 160, but with the polarity of pickup sensor 150 reverse with respect to the polarity of pickup sensor 160. Accordingly, reverse polarity passive boost circuit 600, 600', 600" is hereto able to function to reduce the subtractive effect of the reversed pickup sensor in conventionally wired electric string instruments. When the displaceable contacts 448 and 777 are switched to connect to the switch terminals 776 and 775, respectively, it can be seen that the terminal 602 of reverse polarity passive boost circuit 600, 600', 600" is connected by the conductor 832 to what would be a an open switch terminal 772. In that switch position, no current passes through the reverse polarity passive boost circuit 600, 600', 600" and is thereby non-functional in that switch position. Therefore in this alternate switch position the operation of the circuit is conventional and there is therefore no need to discuss its operation and the current the current path through the circuit.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A reversing configuration control for string instruments having at least a pair of pickup sensors, comprising:

a pair of output terminals;

a respective pair of input terminals coupled to each of the pair of pickup sensors; and a multipole switch having at least two poles, at least a pair of fixed contacts for each of said poles and at least one displaceable contact for each of said poles, said displaceable contacts being mechanically coupled together for concurrent mechanical travel thereof, at least one of said poles being coupled to one of said pair of output terminals and at least one of said displaceable contacts being coupled to one of said input terminals, said multipole switch providing selective operative coupling of the pair of pickup sensors to said output terminals responsive to a position of said displaceable contacts with respect to said mechanical travel thereof, wherein said selective operative coupling includes (a) the pair of pickup sensors being coupled with like polarity in one of series or parallel to said output terminals at a first position of said displaceable contacts, or (b) coupling only one of the pair of pickup sensors to said output terminals, or (c) the pair of pickup sensors being coupled with opposing polarity in one of series or parallel to said output terminals.

2. The reversing configuration control for string instruments as recited in claim 1, where the selective operative coupling of only one of the pair of pickup sensors to said output terminals provided by said multipole switch is a position of said displaceable contacts where said displaceable contacts are electrically connected each to the other or where each said displaceable contact is connected to neither of said pair of fixed contacts of a corresponding pole.

3. The reversing configuration control for string instruments as recited in claim 2, where said one pickup sensor coupled to said output terminals is a bridge pickup coil.

4. The reversing configuration control for string instruments as recited in claim 2, where said selective operative coupling includes (a) the pair of pickup sensors being coupled with like polarity in series to said output terminals, or (b) coupling only one of the pair of pickup sensors to said output terminals, or (c) the pair of pickup sensors being coupled with opposing polarity in series to said output terminals.

5. The reversing configuration control for string instruments as recited in claim 2, where said selective operative coupling includes (a) the pair of pickup sensors being coupled with like polarity in parallel to said output terminals, or (b) coupling only one of the pair of pickup sensors to said output terminals, or (c) the pair of pickup sensors being coupled with opposing polarity in parallel to said output terminals.

6. The reversing configuration control for string instruments as recited in claim 2, where said selective operative coupling includes (a) the pair of pickup sensors being coupled with like polarity in series to said output terminals, or (b) coupling only one of the pair of pickup sensors to said output terminals, or (c) the pair of pickup sensors being coupled with opposing polarity in parallel to said output terminals.

7. The reversing configuration control for string instruments as recited in claim 1, where at least another of said input terminals is coupled to one of said output terminals.

8. The reversing configuration control for string instruments as recited in claim 1, where the other of said displaceable contacts is coupled to said one of said pair of output terminals.

9. The reversing configuration control for string instruments as recited in claim 1, where one input terminal of each of said pair of input terminals are connected together and one of said displaceable contacts is coupled to said interconnected input terminals.

10. The reversing configuration control for string instruments as recited in claim 1, where both of said displaceable contacts are coupled to a respective one of said input terminals.

11. The reversing configuration control for string instruments as recited in claim 1, where both of said displaceable contacts are coupled to a respective one of said pair of output terminals.

12. The reversing configuration control for string instruments as recited in claim 1 further comprising a reverse polarity passive boost circuit coupled in series with one of said pickup sensors responsive to the pair of pickup sensors being selectively operatively coupled with opposing polarity in parallel to said output terminals for attenuating signals of a selected frequency band generated by the one pickup sensor coupled in series therewith.

13. The reversing configuration control for string instruments as recited in claim 12, where said reverse polarity passive boost circuit includes a capacitor.

14. The reversing configuration control for string instruments as recited in claim 13, where said reverse polarity passive boost circuit further includes at least one resistor coupled in parallel with said capacitor.

15. The reversing configuration control for string instruments as recited in claim 14, where said at least one resistor is variable resistor.

16. The reversing configuration control for string instruments as recited in claim 12, where said reverse polarity passive boost circuit includes at least one resistor.

17. The reversing configuration control for string instruments as recited in claim 16, where said at least one resistor is variable resistor.

18. The reversing configuration control for string instruments as recited in claim 1 further comprising a reverse polarity passive boost circuit coupled in parallel with one of said pickup sensors responsive to the pair of pickup sensors being selectively operatively coupled with opposing polarity in series to said output terminals for attenuating signals generated by the one pickup sensor coupled in parallel therewith.

19. The reversing configuration control for string instruments as recited in claim 18, where said reverse polarity passive boost circuit includes at least one resistor.

20. A reversing configuration control for string instruments, comprising:

a pair of pickup sensors;

a pair of output terminals;

a respective pair of input terminals coupled to each of said pair of pickup sensors; and a multipole switch having at least two poles, at least a pair of fixed contacts for each of said poles and at least one displaceable contact for each of said poles, said displaceable contacts being mechanically coupled together for concurrent mechanical travel thereof, at least one of said poles being coupled to one of said pair of output terminals and at least one of said displaceable contacts being coupled to one of said input terminals, said multipole switch providing selective operative coupling of the pair of pickup sensors to said output terminals responsive to a position of said displaceable contacts with respect to said mechanical travel thereof, wherein said selective operative coupling includes (a) the pair of pickup sensors being coupled with like polarity in one of series or parallel to said output terminals at a first position of said displaceable contacts, or (b) coupling only one of the pair of pickup sensors to said output terminals, or (c) the pair of pickup sensors being coupled with opposing polarity in one of series or parallel to said output terminals.

21. The reversing configuration control for string instruments as recited in claim 20, where said selective operative coupling includes (a) the pair of pickup sensors being coupled with like polarity in series to said output terminals, or (b) coupling only one of the pair of pickup sensors to said output terminals, or (c) the pair of pickup sensors being coupled with opposing polarity in series to said output terminals.

22. The reversing configuration control for string instruments as recited in claim 20, where said selective operative coupling includes (a) the pair of pickup sensors being coupled with like polarity in parallel to said output terminals, or (b) coupling only one of the pair of pickup sensors to said output terminals, or (c) the pair of pickup sensors being coupled with opposing polarity in parallel to said output terminals.

23. The reversing configuration control for string instruments as recited in claim 20, where said selective operative coupling includes (a) the pair of pickup sensors being coupled with like polarity in series to said output terminals, or (b) coupling only one of the pair of pickup sensors to said output terminals, or (c) the pair of pickup sensors being coupled with opposing polarity in parallel to said output terminals.

24. A reverse polarity passive boost circuit for increasing output signal amplitude of a string instrument having a pair of pickup sensors selectively coupled together with one having an opposing polarity with respect to the other, the boost circuit comprising:

an attenuation circuit coupled in one of series or parallel relationship with one of the pair of pickup sensors of the string instrument responsive to a polarity reversing control of the string instrument selecting the connection of the pair of pickup sensors coupled with opposing polarity in series or parallel to output terminals of the polarity reversing control, the attenuation circuit attenuating signals of a selected frequency band generated by the one pickup sensor coupled in series or parallel therewith and thereby increasing an amplitude of signals resulting from summation of signals respectively generated by the pair of pickup sensors within the selected frequency band.

25. The reversing configuration control for string instruments as recited in claim 24, where said attenuation circuit is coupled in series with one of said pickup sensors responsive to the pair of pickup sensors being selectively operatively coupled with opposing polarity in parallel to said output terminals, said attenuation circuit including a capacitor and at least one resistor coupled in parallel with said capacitor.

26. The reversing configuration control for string instruments as recited in claim 24, where said attenuation circuit is coupled in parallel with one of said pickup sensors responsive to the pair of pickup sensors being selectively operatively coupled with opposing polarity in series to said output terminals, said attenuation circuit including at least one resistor.

* * * * *